US007581990B2

(12) United States Patent
Kirk et al.

(10) Patent No.: US 7,581,990 B2
(45) Date of Patent: Sep. 1, 2009

(54) HIGH SPEED, HIGH DENSITY ELECTRICAL CONNECTOR WITH SELECTIVE POSITIONING OF LOSSY REGIONS

(75) Inventors: Brian Kirk, Amherst, NH (US); Thomas S. Cohen, New Boston, NH (US)

(73) Assignee: Amphenol Corporation, Nashua, NH (US)

( * ) Notice: Subject to any disclaimer, the term of this patent is extended or adjusted under 35 U.S.C. 154(b) by 0 days.

(21) Appl. No.: 12/062,577

(22) Filed: Apr. 4, 2008

(65) Prior Publication Data

US 2008/0248660 A1 Oct. 9, 2008

Related U.S. Application Data

(60) Provisional application No. 60/921,740, filed on Apr. 4, 2007.

(51) Int. Cl.
*H01R 9/03* (2006.01)

(52) U.S. Cl. ..... 439/608

(58) Field of Classification Search ..... 439/608, 439/79, 701, 108

See application file for complete search history.

(56) References Cited

U.S. PATENT DOCUMENTS 6,409,543 B1 * 6/2002 Astbury, Jr. et al. ..... 439/608
6,506,076 B2 * 1/2003 Cohen et al. ..... 439/608
6,602,095 B2 * 8/2003 Astbury, Jr. et al. ..... 439/608
6,979,202 B2 * 12/2005 Benham et al. ..... 439/65
2001/0012730 A1 * 8/2001 Ramey et al. ..... 439/608
2001/0046810 A1 * 11/2001 Cohen et al. ..... 439/608
2002/0098738 A1 * 7/2002 Astbury, Jr. et al. ..... 439/608
2002/0111069 A1 * 8/2002 Astbury, Jr. et al. ..... 439/608
2002/0123266 A1 * 9/2002 Ramey et al. ..... 439/608
2003/0220018 A1 * 11/2003 Winings et al. ..... 439/608
2004/0171305 A1 * 9/2004 McGowan et al. ..... 439/608
2004/0235352 A1 * 11/2004 Takemasa ..... 439/608
2005/0048842 A1 * 3/2005 Benham et al. ..... 439/608
2006/0068640 A1 * 3/2006 Gailus ..... 439/608
2006/0292932 A1 * 12/2006 Benham et al. ..... 439/608

* cited by examiner

*Primary Examiner*—Neil Abrams
*Assistant Examiner*—Harshad C Patel
(74) *Attorney, Agent, or Firm*—Wolf, Greenfield & Sacks P.C.

(57) ABSTRACT

An electrical interconnection system with high speed, high density electrical connectors. The connectors incorporate electrically lossy material, selectively positioned to reduce crosstalk without undesirably attenuating signals. The lossy material may be molded through ground conductors that separate adjacent differential pairs within columns of conductive elements in the connector. However, regions of lossy material may be set back from the edges of the ground conductors to avoid undesired attenuation of signals. Also, the lossy material may be positioned in multiple regions along the length of signal conductors. The regions may be separated by holes, notches, gaps or other openings in the lossy material, which can be simply formed as part of a molding operation.

32 Claims, 12 Drawing Sheets

HIGH SPEED, HIGH DENSITY ELECTRICAL CONNECTOR WITH SELECTIVE POSITIONING OF LOSSY REGIONS

CROSS-REFERENCE TO RELATED APPLICATIONS

This application claims priority to U.S. Provisional Application 60/921,740, filed Apr. 4, 2007 and incorporated herein by reference.

BACKGROUND OF INVENTION

1. Field of Invention

This invention relates generally to electrical interconnection systems and more specifically to improved signal integrity in interconnection systems, particularly in high speed electrical connectors.

2. Discussion of Related Art

Electrical connectors are used in many electronic systems. It is generally easier and more cost effective to manufacture a system on several printed circuit boards ("PCBs") that are connected to one another by electrical connectors than to manufacture a system as a single assembly. A traditional arrangement for interconnecting several PCBs is to have one PCB serve as a backplane. Other PCBs, which are called daughter boards or daughter cards, are then connected through the backplane by electrical connectors.

Electronic systems have generally become smaller, faster and functionally more complex. These changes mean that the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

One of the difficulties in making a high density, high speed connector is that electrical conductors in the connector can be so close that there can be electrical interference between adjacent signal conductors. To reduce interference, and to otherwise provide desirable electrical properties, metal members are often placed between or around adjacent signal conductors. The metal acts as a shield to prevent signals carried on one conductor from creating "crosstalk" on another conductor. The metal also impacts the impedance of each conductor, which can further contribute to desirable electrical properties.

As signal frequencies increase, there is a greater possibility of electrical noise being generated in the connector in forms such as reflections, crosstalk and electromagnetic radiation. Therefore, the electrical connectors are designed to limit crosstalk between different signal paths and to control the characteristic impedance of each signal path. Shield members are often placed adjacent the signal conductors for this purpose.

Crosstalk between different signal paths through a connector can be limited by arranging the various signal paths so that they are spaced further from each other and nearer to a shield, such as a grounded plate. Thus, the different signal paths tend to electromagnetically couple more to the shield and less with each other. For a given level of crosstalk, the signal paths can be placed closer together when sufficient electromagnetic coupling to the ground conductors is maintained.

Although shields for isolating conductors from one another are typically made from metal components, U.S. Pat. No. 6,709,294 (the '294 patent), which is assigned to the same assignee as the present application and which is hereby incorporated by reference in its entirety, describes making an extension of a shield plate in a connector from conductive plastic.

Other techniques may be used to control the performance of a connector. Transmitting signals differentially can also reduce crosstalk. Differential signals are carried on by a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. No shielding is desired between the conducting paths of the pair, but shielding may be used between differential pairs. Electrical connectors can be designed for differential signals as well as for single-ended signals.

Examples of differential electrical connectors are shown in U.S. Pat. No. 6,293,827, U.S. Pat. No. 6,503,103, U.S. Pat. No. 6,776,659, and U.S. Pat. No. 7,163,421, all of which are assigned to the assignee of the present application and are hereby incorporated by reference in their entireties.

Electrical characteristics of a connector may also be controlled through the use of absorptive material. U.S. Pat. No. 6,786,771, (the '771 patent), which is assigned to the assignee of the present application and which is hereby incorporated by reference in its entirety, describes the use of absorptive material to reduce unwanted resonances and improve connector performance, particularly at high speeds (for example, signal frequencies of 1 GHz or greater, particularly above 3 GHz).

U.S. Published Application 2006/0068640, which is assigned to the assignee of the present invention and which is hereby incorporated by reference in its entirety, describes the use of lossy material to improve connector performance.

SUMMARY OF INVENTION

An improved electrical connector is provided with selective positioning of lossy regions. The lossy regions can reduce crosstalk between adjacent signal conductors without producing an undesirable amount of attenuation for signals carried by those signal conductors. One technique for selectively positioning lossy regions involves providing multiple segments of lossy material separated by insulative regions along signal conductors. Another technique involves positioning lossy regions in association with ground conductors and positioning the lossy regions with a setback from edges of the ground conductors. A further technique involves positioning the lossy regions to extend through ground conductors. A further technique involves positioning the lossy regions between adjacent parallel columns of conductive elements in a volume that is between both two ground conductors and two signal conductors in adjacent columns. These techniques may be used singly or in combination.

Accordingly, in one aspect, the invention relates to an electrical connector comprising a plurality of signal conductors. The plurality of signal conductors are disposed in an array. The connector has a housing that comprises at least one insulative member disposed to hold the plurality of signal conductors in the array. The housing also includes at least one lossy member disposed along a length of a signal conductor to provide a plurality of lossy regions between the signal conductor and an adjacent signal conductor with at least one insulative region between adjacent lossy regions.

In another aspect, the invention relates to an electrical connector comprising a plurality of signal conductors. The plurality of signal conductors are disposed in an array having at least one column. The connector has a housing comprising a plurality of lossy regions. Each lossy region is disposed adjacent at least one of the plurality of signal conductors. A plurality of ground conductors in the connector are each disposed in a column of the at least one column. Each ground conductor is disposed adjacent at least one signal conductor of the plurality of signal conductors in the column and has at least one edge facing the at least one adjacent signal conductor. Lossy regions of the plurality of lossy regions are positioned relative to ground conductors of the plurality of ground conductors with a setback from the edge of the ground conductor in a direction away from the signal conductor adjacent the ground conductor.

In yet a further aspect, the invention relates to an electrical connector comprising a plurality of signal conductors. The plurality of signal conductors are disposed in an array having at least one column. The connector has a housing comprising a plurality of lossy regions. Each lossy region is adjacent at least one of the plurality of signal conductors. A plurality of ground conductors with the connector each has an opening therethrough. Each of the ground conductors is disposed in a column of the at least one column, and each of the ground conductors is in electrical connection with a lossy region of the plurality of lossy regions. A portion of the lossy region in electrical connection with each ground conductor is disposed through the opening in the ground conductor.

In yet a further aspect, the invention relates to an electrical connector comprising a plurality of signal conductors. The plurality of signal conductors is disposed in an array having a plurality of columns. The connector also has a plurality of ground conductors, each disposed in a column of the plurality of columns. A housing for the connector comprises a plurality of lossy regions. The lossy regions are positioned: i) between two adjacent columns in regions between two adjacent signal conductors, each of the two adjacent signal conductors being in a different one of the two adjacent columns; and ii) between two adjacent ground conductors, each of the two adjacent ground conductors being in one of the two adjacent columns.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
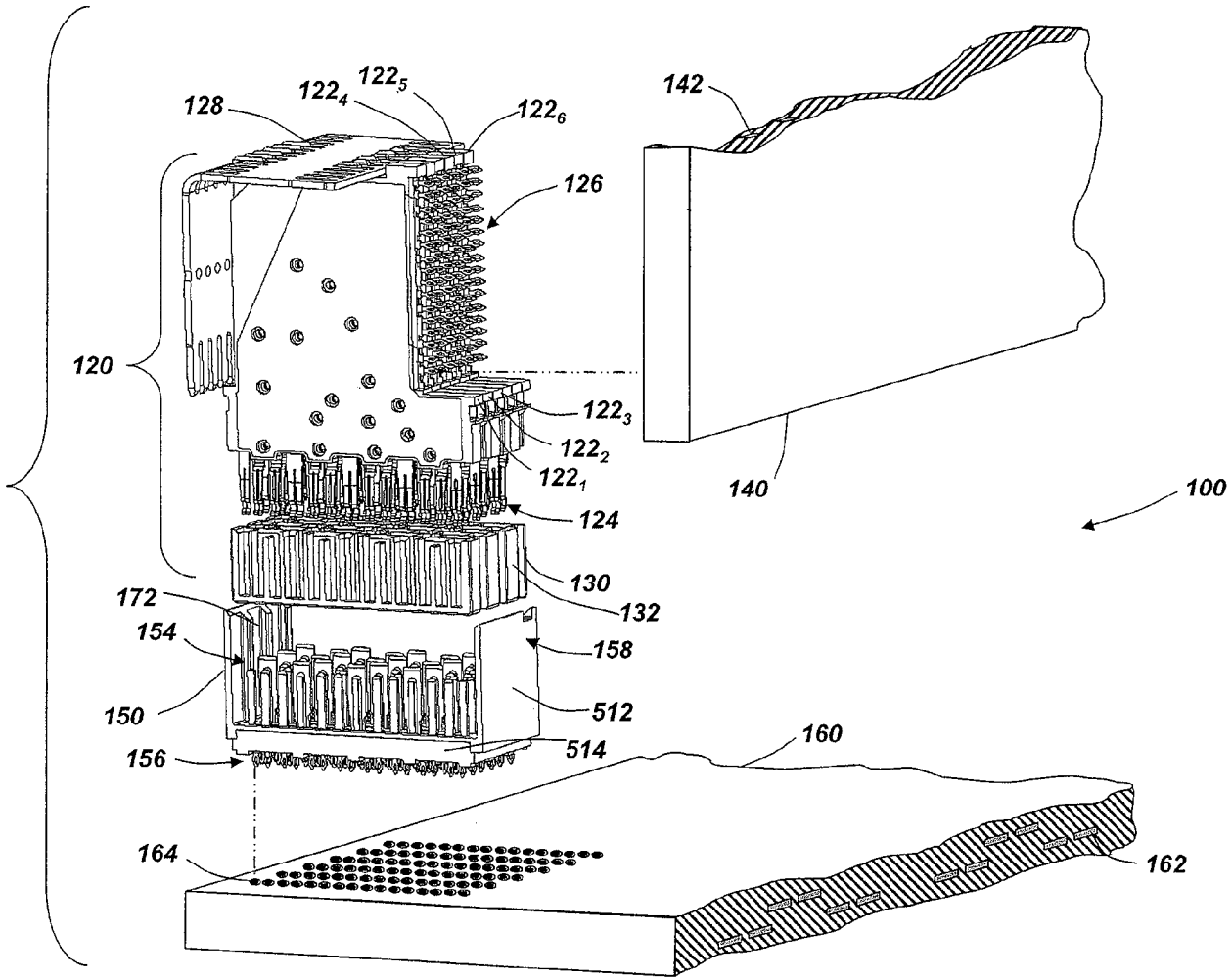
FIG. 1 is a perspective view of an electrical interconnection system according to an embodiment of the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

Referring to FIG. 1, an electrical interconnection system 100 with two connectors is shown. The electrical interconnection system 100 includes a daughter card connector 120 and a backplane connector 150.

Daughter card connector 120 is designed to mate with backplane connector 150, creating electronically conducting paths between backplane 160 and daughter card 140. Though not expressly shown, interconnection system 100 may interconnect multiple daughter cards having similar daughter card connectors that mate to similar backplane connections on backplane 160. Accordingly, the number and type of subassemblies connected through an interconnection system is not a limitation on the invention.

FIG. 1 shows an interconnection system using a right-angle, backplane connector. It should be appreciated that in other embodiments, the electrical interconnection system 100 may include other types and combinations of connectors, as the invention may be broadly applied in many types of electrical connectors, such as right angle connectors, mezzanine connectors, card edge connectors and chip sockets.

Backplane connector 150 and daughter connector 120 each contains conductive elements. The conductive elements of daughter card connector 120 are coupled to traces, of which trace 142 is numbered, ground planes or other conductive elements within daughter card 140. The traces carry electrical signals and the ground planes provide reference levels for components on daughter card 140. Ground planes may have voltages that are at earth ground or positive or negative with respect to earth ground, as any voltage level may act as a reference level.

Similarly, conductive elements in backplane connector 150 are coupled to traces, of which trace 162 is numbered, ground planes or other conductive elements within backplane 160. When daughter card connector 120 and backplane connector 150 mate, conductive elements in the two connectors mate to complete electrically conductive paths between the conductive elements within backplane 160 and daughter card 140.

Figure 6C:
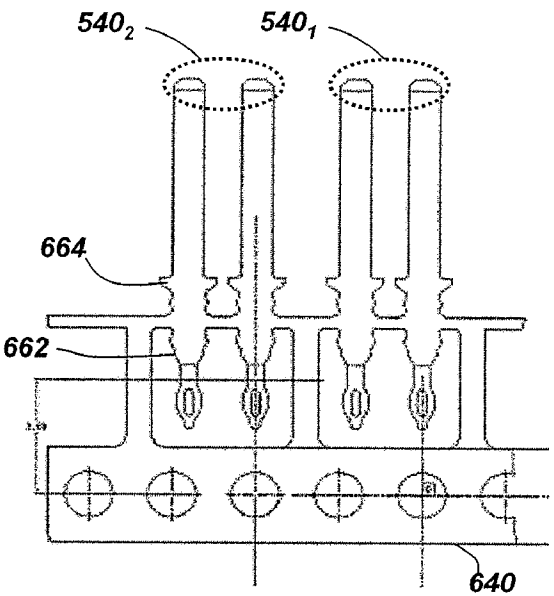
FIGS. 6A-6C are enlarged detail views of conductors used in the manufacture of a backplane connector according to an embodiment of the present invention.
Figure 6B:
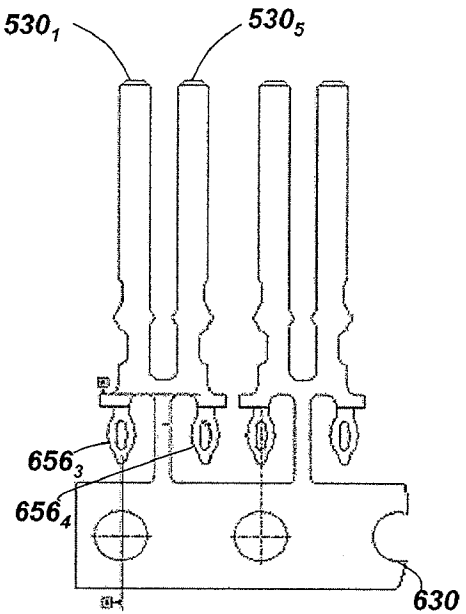
Figure 6A:
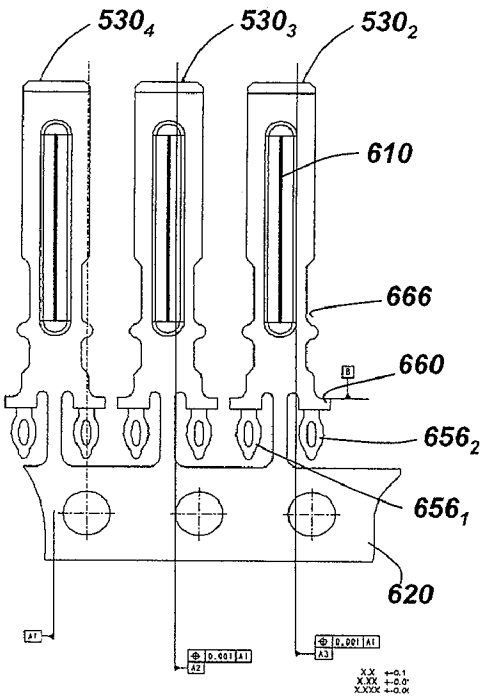

Backplane connector 150 includes a backplane shroud 158 and a plurality conductive elements (see FIGS. 6A-6C). The conductive elements of backplane connector 150 extend through floor 514 of the backplane shroud 158 with portions both above and below floor 514. Here, the portions of the conductive elements that extend above floor 514 form mating contacts, shown collectively as mating contact portions 154, which are adapted to mate to corresponding conductive elements of daughter card connector 120. In the illustrated embodiment, mating contacts 154 are in the form of blades, although other suitable contact configurations may be employed, as the present invention is not limited in this regard.

Tail portions, shown collectively as contact tails 156, of the conductive elements extend below the shroud floor 514 and are adapted to be attached to backplane 160. Here, the tail portions are in the form of a press fit, "eye of the needle" compliant sections that fit within via holes, shown collectively as via holes 164, on backplane 160. However, other configurations are also suitable, such as surface mount elements, spring contacts, solderable pins, etc., as the present invention is not limited in this regard.

In the embodiment illustrated, backplane shroud 158 is molded from a dielectric material such as plastic or nylon. Examples of suitable materials are liquid crystal polymer (LCP), polyphenyline sulfide (PPS), high temperature nylon or polypropylene (PPO). Other suitable materials may be employed, as the present invention is not limited in this regard. All of these are suitable for use as binder materials in manufacturing connectors according to the invention. One or more fillers may be included in some or all of the binder material used to form backplane shroud 158 to control the electrical or mechanical properties of backplane shroud 150. For example, thermoplastic PPS filled to 30% by volume with glass fiber may be used to form shroud 158.

In the embodiment illustrated, backplane connector 150 is manufactured by molding backplane shroud 158 with openings to receive conductive elements. The conductive elements may be shaped with barbs or other retention features that hold the conductive elements in place when inserted in the opening of backplane shroud 158.

Figure 5A:
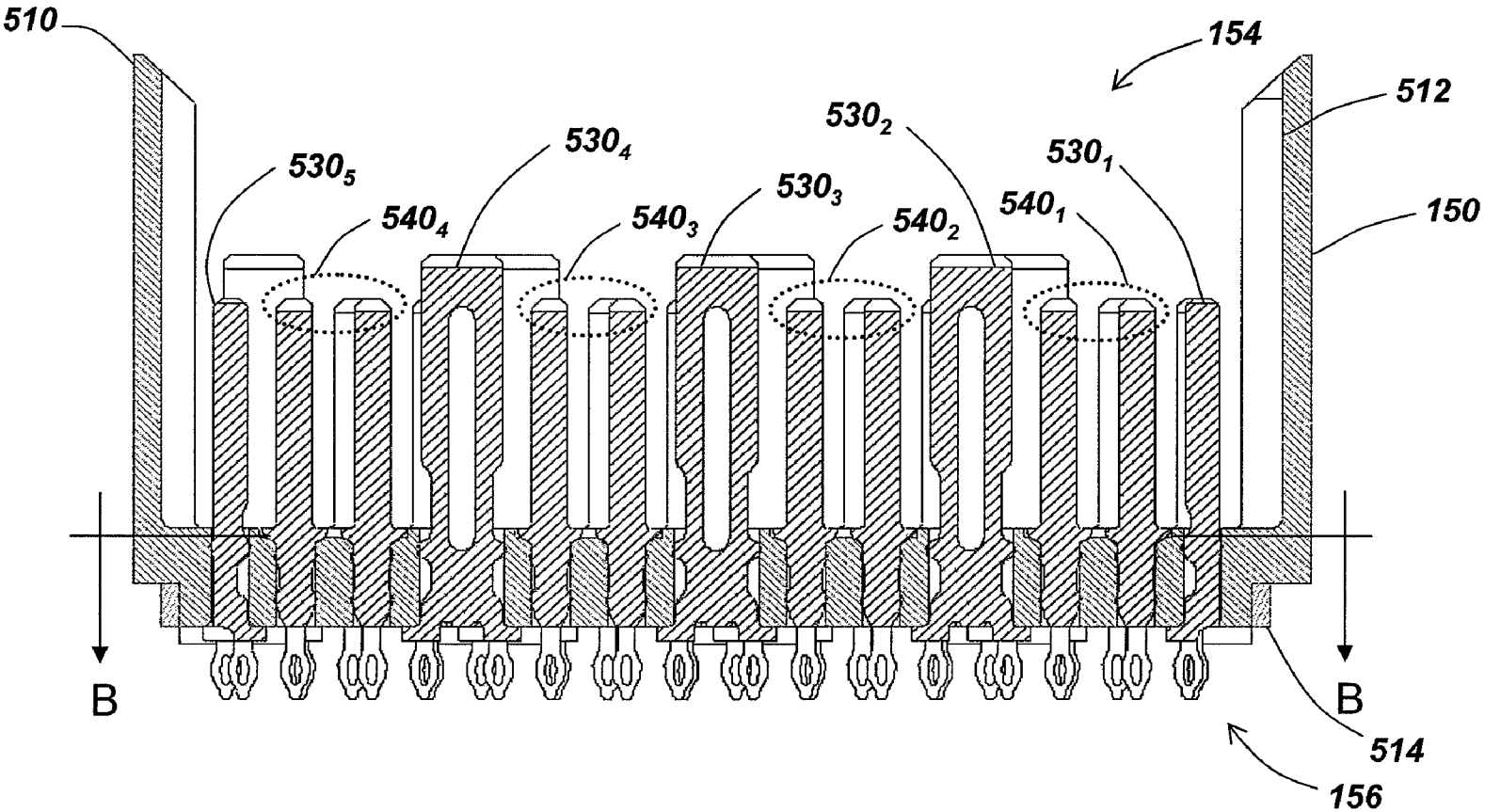
FIG. 5A is a cross-sectional representation of a backplane connector according to an embodiment of the present invention.

As shown in FIG. 1 and FIG. 5A, the backplane shroud 158 further includes side walls 512 that extend along the length of opposing sides of the backplane shroud 158. The side walls 512 include grooves 172, which run vertically along an inner surface of the side walls 512. Grooves 172 serve to guide front housing 130 of daughter card connector 120 via mating projections 132 into the appropriate position in shroud 158.

Daughter card connector 120 includes a plurality of wafers $\mathbf{122}_1 \ldots \mathbf{122}_6$ coupled together, with each of the plurality of wafers $\mathbf{122}_1 \ldots \mathbf{122}_6$ having a housing 260 (see FIGS. 2A-2C) and a column of conductive elements. In the illustrated embodiment, each column has a plurality of signal conductors 420 (see FIG. 4A) and a plurality of ground conductors 430 (see FIG. 4A). The ground conductors may be employed within each wafer $\mathbf{122}_1 \ldots \mathbf{122}_6$ to minimize crosstalk between signal conductors or to otherwise control the electrical properties of the connector.

Wafers $\mathbf{122}_1 \ldots \mathbf{122}_6$ may be formed by molding housing 260 around conductive elements that form signal and ground conductors. As with shroud 158 of backplane connector 150, housing 260 may be formed of any suitable material and may include portions that have conductive filler or are otherwise made lossy.

In the illustrated embodiment, daughter card connector 120 is a right angle connector and has conductive elements that traverse a right angle. As a result, opposing ends of the conductive elements extend from perpendicular edges of the wafers $\mathbf{122}_1 \ldots \mathbf{122}_6$.

Each conductive element of wafers $\mathbf{122}_1 \ldots \mathbf{122}_6$ has at least one contact tail, shown collectively as contact tails 126 that can be connected to daughter card 140. Each conductive element in daughter card connector 120 also has a mating contact portion, shown collectively as mating contacts 124, which can be connected to a corresponding conductive element in backplane connector 150. Each conductive element also has an intermediate portion between the mating contact portion and the contact tail, which may be enclosed by or embedded within a wafer housing 260 (see FIG. 2).

The contact tails 126 electrically connect the conductive elements within daughter card and connector 120 to conductive elements, such as traces 142 in daughter card 140. In the embodiment illustrated, contact tails 126 are press fit "eye of the needle" contacts that make an electrical connection through via holes in daughter card 140. However, any suitable attachment mechanism may be used instead of or in addition to via holes and press fit contact tails.

In the illustrated embodiment, each of the mating contacts 124 has a dual beam structure configured to mate to a corresponding mating contact 154 of backplane connector 150. The conductive elements acting as signal conductors may be grouped in pairs, separated by ground conductors in a configuration suitable for use as a differential electrical connector. However, embodiments are possible for single-ended use in which the conductive elements are evenly spaced without designated ground conductors separating signal conductors or with a ground conductor between each signal conductor.

In the embodiments illustrated, some conductive elements are designated as forming a differential pair of conductors and some conductive elements are designated as ground conductors. These designations refer to the intended use of the conductive elements in an interconnection system as they would be understood by one of skill in the art. For example, though other uses of the conductive elements may be possible, differential pairs may be identified based on preferential coupling between the conductive elements that make up the pair. Electrical characteristics of the pair, such as its impedance, that make it suitable for carrying a differential signal may provide an alternative or additional method of identifying a differential pair. As another example, in a connector with differential pairs, ground conductors may be identified by their positioning relative to the differential pairs. In other instances, ground conductors may be identified by their shape or electrical characteristics. For example, ground conductors may be relatively wide to provide low inductance, which is desirable for providing a stable reference potential, but provides an impedance that is undesirable for carrying a high speed signal.

For exemplary purposes only, daughter card connector 120 is illustrated with six wafers $\mathbf{122}_1 \ldots \mathbf{122}_6$, with each wafer having a plurality of pairs of signal conductors and adjacent ground conductors. As pictured, each of the wafers $\mathbf{122}_1 \ldots \mathbf{122}_6$ includes one column of conductive elements. However, the present invention is not limited in this regard, as the number of wafers and the number of signal conductors and ground conductors in each wafer may be varied as desired.

As shown, each wafer $\mathbf{122}_1 \ldots \mathbf{122}_6$ is inserted into front housing 130 such that mating contacts 124 are inserted into and held within openings in front housing 130. The openings in front housing 130 are positioned so as to allow mating contacts 154 of the backplane connector 150 to enter the openings in front housing 130 and allow electrical connection with mating contacts 124 when daughter card connector 120 is mated to backplane connector 150.

Daughter card connector 120 may include a support member instead of or in addition to front housing 130 to hold wafers $\mathbf{122}_1 \ldots \mathbf{122}_6$. In the pictured embodiment, stiffener 128 supports the plurality of wafers $\mathbf{122}_1 \ldots \mathbf{122}_6$. Stiffener 128 is, in the embodiment illustrated, a stamped metal member. Though, stiffener 128 may be formed from any suitable material. Stiffener 128 may be stamped with slots, holes, grooves or other features that can engage a wafer.

Each wafer $\mathbf{122}_1 \ldots \mathbf{122}_6$ may include attachment features 242, 244 (see FIG. 2A-2B) that engage stiffener 128 to locate each wafer 122 with respect to another and further to prevent rotation of the wafer 122. Of course, the present invention is not limited in this regard, and no stiffener need be employed. Further, although the stiffener is shown attached to an upper and side portion of the plurality of wafers, the present invention is not limited in this respect, as other suitable locations may be employed.

Figure 2B:
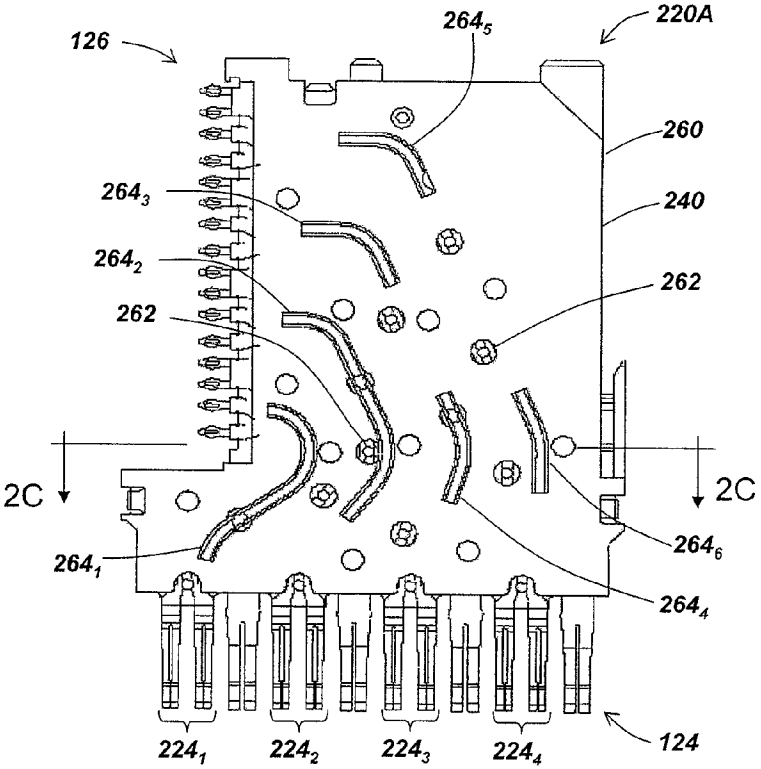
FIGS. 2A and 2B are views of a first and second side of a wafer forming a portion of the electrical connector of FIG. 1.
Figure 2A:
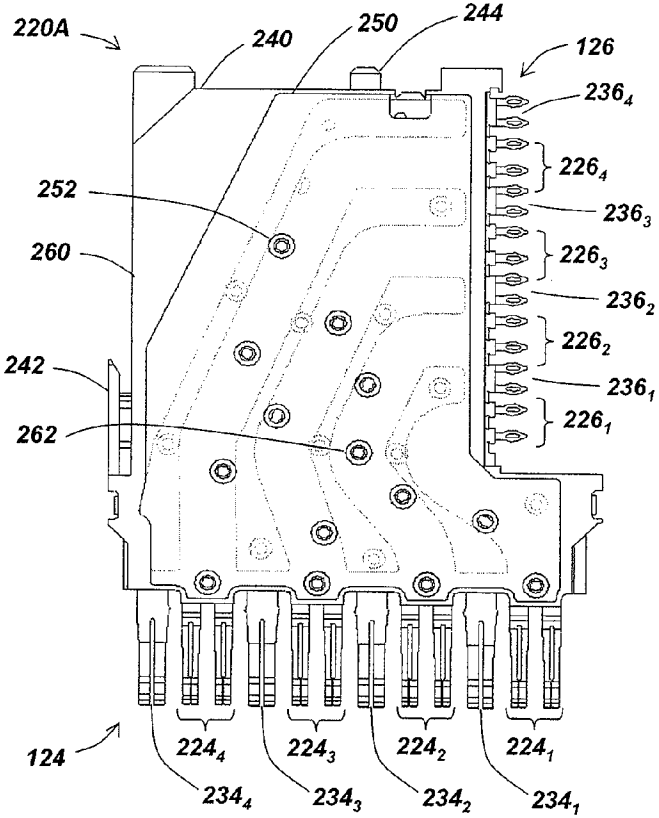

FIGS. 2A-2B illustrate opposing side views of an exemplary wafer 220A. Wafer 220A may be formed in whole or in part by injection molding of material to form housing 260 around a wafer strip assembly such as 410A or 410B (FIG. 4). In the pictured embodiment, wafer 220A is formed with a two shot molding operation, allowing housing 260 to be formed of two types of material having different material properties. Insulative portion 240 is formed in a first shot and lossy portion 250 is formed in a second shot. However, any suitable number and types of material may be used in housing 260. In one embodiment, the housing 260 is formed around a column of conductive elements by injection molding plastic.

In some embodiments, housing 260 may be provided with openings, such as windows or slots $\mathbf{264}_1 \ldots \mathbf{264}_6$, and holes, of which hole 262 is numbered, adjacent the signal conductors 420. These openings may serve multiple purposes, including to: (i) ensure during an injection molding process that the conductive elements are properly positioned, and (ii) facilitate insertion of materials that have different electrical properties, if so desired.

To obtain the desired performance characteristics, one embodiment of the present invention may employ regions of different dielectric constant selectively located adjacent signal conductors $\mathbf{310}_1$B, $\mathbf{310}_2$B . . . $\mathbf{310}_4$B of a wafer. For example, in the embodiment illustrated in FIGS. 2A-2C, the housing 260 includes slots $\mathbf{264}_1 \ldots \mathbf{264}_6$ in housing 260 that position air adjacent signal conductors $\mathbf{310}_1$B, $\mathbf{310}_2$B . . . $\mathbf{310}_4$B.

The ability to place air, or other material that has a dielectric constant lower than the dielectric constant of material used to form other portions of housing 260, in close proximity to one half of a differential pair provides a mechanism to de-skew a differential pair of signal conductors. The time it takes an electrical signal to propagate from one end of the signal connector to the other end is known as the propagation delay. In some embodiments, it is desirable that each signal within a pair have the same propagation delay, which is commonly referred to as having zero skew within the pair. The propagation delay within a conductor is influenced by the dielectric constant of material near the conductor, where a lower dielectric constant means a lower propagation delay. The dielectric constant is also sometimes referred to as the relative permittivity. A vacuum has the lowest possible dielectric constant with a value of 1. Air has a similarly low dielectric constant, whereas dielectric materials, such as LCP, have higher dielectric constants. For example, LCP has a dielectric constant of between about 2.5 and about 4.5.

Each signal conductor of the signal pair may have a different physical length, particularly in a right-angle connector. According to one aspect of the invention, to equalize the propagation delay in the signal conductors of a differential pair even though they have physically different lengths, the relative proportion of materials of different dielectric constants around the conductors may be adjusted. In some embodiments, more air is positioned in close proximity to the physically longer signal conductor of the pair than for the shorter signal conductor of the pair, thus lowering the effective dielectric constant around the signal conductor and decreasing its propagation delay.

However, as the dielectric constant is lowered, the impedance of the signal conductor rises. To maintain balanced impedance within the pair, the size of the signal conductor in closer proximity to the air may be increased in thickness or width. This results in two signal conductors with different physical geometry, but a more equal propagation delay and more inform impedance profile along the pair.

Figure 2C:
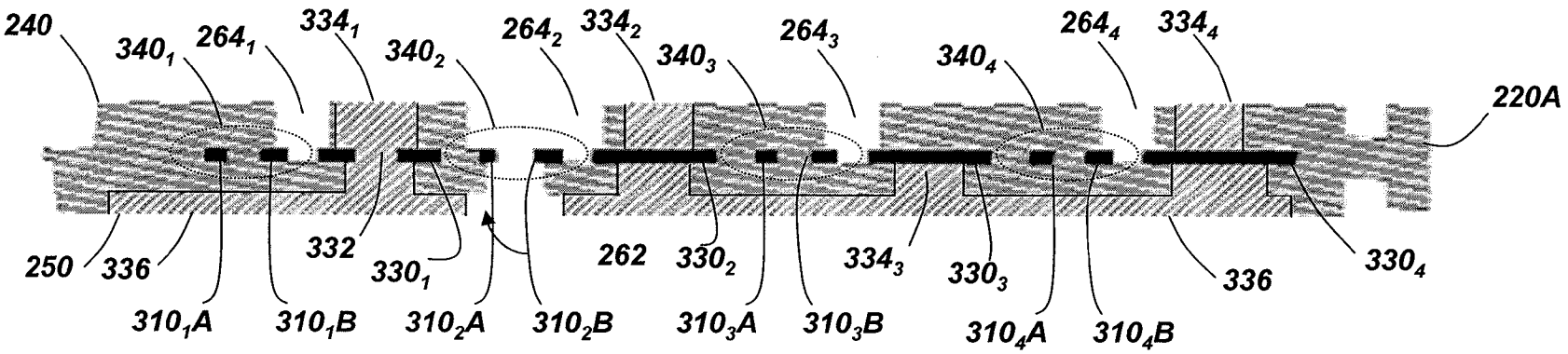
FIG. 2C is a cross-sectional representation of the wafer illustrated in FIG. 2B taken along the line 2C-2C.

FIG. 2C shows a wafer 220 in cross section taken along the line 2C-2C in FIG. 2B. As shown, a plurality of differential pairs $\mathbf{340}_1 \ldots \mathbf{340}_4$ are held in an array within insulative portion 240 of housing 260. In the illustrated embodiment, the array, in cross-section, is a linear array, forming a column of conductive elements.

Slots $\mathbf{264}_1 \ldots \mathbf{264}_4$ are intersected by the cross section and are therefore visible in FIG. 2C. As can be seen, slots $\mathbf{264}_1 \ldots \mathbf{264}_4$ create regions of air adjacent the longer conductor in each differential pair $\mathbf{340}_1$, $\mathbf{340}_2 \ldots \mathbf{340}_4$. Though, air is only one example of a material with a low dielectric constant that may be used for de-skewing a connector. Regions comparable to those occupied by slots $\mathbf{264}_1 \ldots \mathbf{264}_4$ as shown in FIG. 2C could be formed with a plastic with a lower dielectric constant than the plastic used to form other portions of housing 260. As another example, regions of lower dielectric constant could be formed using different types or amounts of fillers. For example, lower dielectric constant regions could be molded from plastic having less glass fiber reinforcement than in other regions.

FIG. 2C also illustrates positioning and relative dimensions of signal and ground conductors that may be used in some embodiments. As shown in FIG. 2C, intermediate portions of the signal conductors $\mathbf{310}_1$A . . . $\mathbf{310}_4$A and $\mathbf{310}_1$B . . . $\mathbf{310}_4$B are embedded within housing 260 to form a column. Intermediate portions of ground conductors $\mathbf{330}_1 \ldots \mathbf{330}_4$ may also be held within housing 260 in the same column.

Ground conductors $\mathbf{330}_1$, $\mathbf{330}_2$ and $\mathbf{330}_3$ are positioned between two adjacent differential pairs $\mathbf{340}_1$, $\mathbf{340}_2 \ldots \mathbf{340}_4$ within the column. Additional ground conductors may be included at either or both ends of the column. In wafer 220A, as illustrated in FIG. 2C, a ground conductor $\mathbf{330}_4$ is positioned at one end of the column. As shown in FIG. 2C, in some embodiments, each ground conductor $\mathbf{330}_1 \ldots \mathbf{330}_4$ is preferably wider than the signal conductors of differential pairs $\mathbf{340}_1 \ldots \mathbf{340}_4$. In the cross-section illustrated, the intermediate portion of each ground conductor has a width that is equal to or greater than three times the width of the intermediate portion of a signal conductor. In the pictured embodiment, the width of each ground conductor is sufficient to span at least the same distance along the column as a differential pair.

In the pictured embodiment, each ground conductor has a width approximately five times the width of a signal conductor such that in excess of 50% of the column width occupied by the conductive elements is occupied by the ground conductors. In the illustrated embodiment, approximately 70% of the column width occupied by conductive elements is occupied by the ground conductors $330_1 \ldots 330_4$. Increasing the percentage of each column occupied by a ground conductor can decrease cross talk within the connector.

Other techniques can also be used to manufacture wafer 220A to reduce crosstalk or otherwise have desirable electrical properties. In some embodiments, one or more portions of the housing 260 are formed from a material that selectively alters the electrical and/or electromagnetic properties of that portion of the housing, thereby suppressing noise and/or crosstalk, altering the impedance of the signal conductors or otherwise imparting desirable electrical properties to the signal conductors of the wafer.

In the embodiment illustrated in FIGS. 2A-2C, housing 260 includes an insulative portion 240 and a lossy portion 250. In one embodiment, the lossy portion 250 may include a thermoplastic material filled with conducting particles. The fillers make the portion "electrically lossy." In one embodiment, the lossy regions of the housing are configured to reduce crosstalk between at least two adjacent differential pairs $340_1 \ldots 340_4$. The insulative regions of the housing may be configured so that the lossy regions do not attenuate signals carried by the differential pairs $340_1 \ldots 340_4$ an undesirable amount.

Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally be between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz. or 3 to 6 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material.

Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter and most preferably about 1 siemans/meter to about 30,000 siemans/meter.

Electrically lossy materials may be partially conductive materials, such as those that have a surface resistivity between 1 Ω/square and $10^6$ Ω/square. In some embodiments, the electrically lossy material has a surface resistivity between 1 Ω/square and $10^3$ Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. In some embodiments, the conductive particles disposed in the lossy portion 250 of the housing may be disposed generally evenly throughout, rendering a conductivity of the lossy portion generally constant. An other embodiments, a first region of the lossy portion 250 may be more conductive than a second region of the lossy portion 250 so that the conductivity, and therefore amount of loss within the lossy portion 250 may vary.

The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. However, many alternative forms of binder materials may be used. Curable materials, such as epoxies, can serve as a binder. Alternatively, materials such as thermosetting resins or adhesives may be used. Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic housing. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive preform, such as those sold by Techfilm of Billerica, Mass., US may also be used. This preform can include an epoxy binder filled with carbon particles. The binder surrounds carbon particles, which acts as a reinforcement for the preform. Such a preform may be inserted in a wafer 220A to form all or part of the housing and may be positioned to adhere to ground conductors in the wafer. In some embodiments, the preform may adhere through the adhesive in the preform, which may be cured in a heat treating process. Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In the embodiment illustrated in FIG. 2C, the wafer housing 260 is molded with two types of material. In the pictured embodiment, lossy portion 250 is formed of a material having a conductive filler, whereas the insulative portion 240 is formed from an insulative material having little or no conductive fillers, though insulative portions may have fillers, such as glass fiber, that alter mechanical properties of the binder material or impacts other electrical properties, such as dielectric constant, of the binder. In one embodiment, the insulative portion 240 is formed of molded plastic and the lossy portion is formed of molded plastic with conductive fillers. In some embodiments, the lossy portion 250 is sufficiently lossy that it attenuates radiation between differential pairs to a sufficient amount that crosstalk is reduced to a level that a separate metal plate is not required.

To prevent signal conductors $\mathbf{310}_1$A, $\mathbf{310}_1$B . . . $\mathbf{310}_4$A, and $\mathbf{310}_4$B from being shorted together and/or from being shorted to ground by lossy portion 250, insulative portion 240, formed of a suitable dielectric material, may be used to insulate the signal conductors. The insulative materials may be, for example, a thermoplastic binder into which non-conducting fibers are introduced for added strength, dimensional stability and to reduce the amount of higher priced binder used. Glass fibers, as in a conventional electrical connector, may have a loading of about 30% by volume. It should be appreciated that in other embodiments, other materials may be used, as the invention is not so limited.

In the embodiment of FIG. 2C, the lossy portion 250 includes a parallel region 336 and perpendicular regions $\mathbf{334}_1$ . . . $\mathbf{334}_4$. In one embodiment, perpendicular regions $\mathbf{334}_1$ . . . $\mathbf{334}_4$ are disposed between adjacent conductive elements that form separate differential pairs $\mathbf{340}_1$ . . . $\mathbf{340}_4$.

In some embodiments, the lossy regions 336 and $\mathbf{334}_1$ . . . $\mathbf{334}_4$ of the housing 260 and the ground conductors $\mathbf{330}_1$ . . . $\mathbf{330}_4$ cooperate to shield the differential pairs $\mathbf{340}_1$ . . . $\mathbf{340}_4$ to reduce crosstalk. The lossy regions 336 and $\mathbf{334}_1$ . . . $\mathbf{334}_4$ may be grounded by being electrically connected to one or more ground conductors. This configuration of lossy material in combination with ground conductors $\mathbf{330}_1$ . . . $\mathbf{330}_4$ reduces crosstalk between differential pairs within a column.

As shown in FIG. 2C, portions of the ground conductors $\mathbf{330}_1$ . . . $\mathbf{330}_4$, may be electrically connected to regions 336 and $\mathbf{334}_1$ . . . $\mathbf{334}_4$ by molding portion 250 around ground conductors $\mathbf{340}_1$ . . . $\mathbf{340}_4$. In some embodiments, ground conductors may include openings through which the material forming the housing can flow during molding. For example, the cross section illustrated in FIG. 2C is taken through an opening 332 in ground conductor $\mathbf{330}_1$. Though not visible in the cross section of FIG. 2C, other openings in other ground conductors such as $\mathbf{330}_2$ . . . $\mathbf{330}_4$ may be included.

Material that flows through openings in the ground conductors allows perpendicular portions $\mathbf{334}_1$ . . . $\mathbf{334}_4$ to extend through ground conductors even though a mold cavity used to form a wafer 220A has inlets on only one side of the ground conductors. Additionally, flowing material through openings in ground conductors as part of a molding operation may aid in securing the ground conductors in housing 260 and may enhance the electrical connection between the lossy portion 250 and the ground conductors. However, other suitable methods of forming perpendicular portions $\mathbf{334}_1$ . . . $\mathbf{334}_4$ may also be used, including molding wafer 320A in a cavity that has inlets on two sides of ground conductors $\mathbf{330}_1$ . . . $\mathbf{330}_4$. Likewise, other suitable methods for securing the ground contacts 330 may be employed, as the present invention is not limited in this respect.

Forming the lossy portion 250 of the housing from a moldable material can provide additional benefits. For example, the lossy material at one or more locations can be configured to set the performance of the connector at that location. For example, changing the thickness of a lossy portion to space signal conductors closer to or further away from the lossy portion 250 can alter the performance of the connector. As such, electromagnetic coupling between one differential pair and ground and another differential pair and ground can be altered, thereby configuring the amount of loss for radiation between adjacent differential pairs and the amount of loss to signals carried by those differential pairs. As a result, a connector according to embodiments of the invention may be capable of use at higher frequencies than conventional connectors, such as for example at frequencies between 10-15 GHz.

As shown in the embodiment of FIG. 2C, wafer 220A is designed to carry differential signals. Thus, each signal is carried by a pair of signal conductors 310A and $\mathbf{310}_1$B, . . . $\mathbf{310}_4$A and $\mathbf{310}_4$B. Preferably, each signal conductor is closer to the other conductor in its pair than it is to a conductor in an adjacent pair. For example, a pair $\mathbf{340}_1$ carries one differential signal, and pair $\mathbf{340}_2$ carries another differential signal. As can be seen in the cross section of FIG. 2C, signal conductor $\mathbf{310}_1$B is closer to signal conductor $\mathbf{310}_1$A than to signal conductor $\mathbf{310}_2$A. Perpendicular lossy regions $\mathbf{334}_1$ . . . $\mathbf{334}_4$ may be positioned between pairs to provide shielding between the adjacent differential pairs in the same column.

Figure 3:
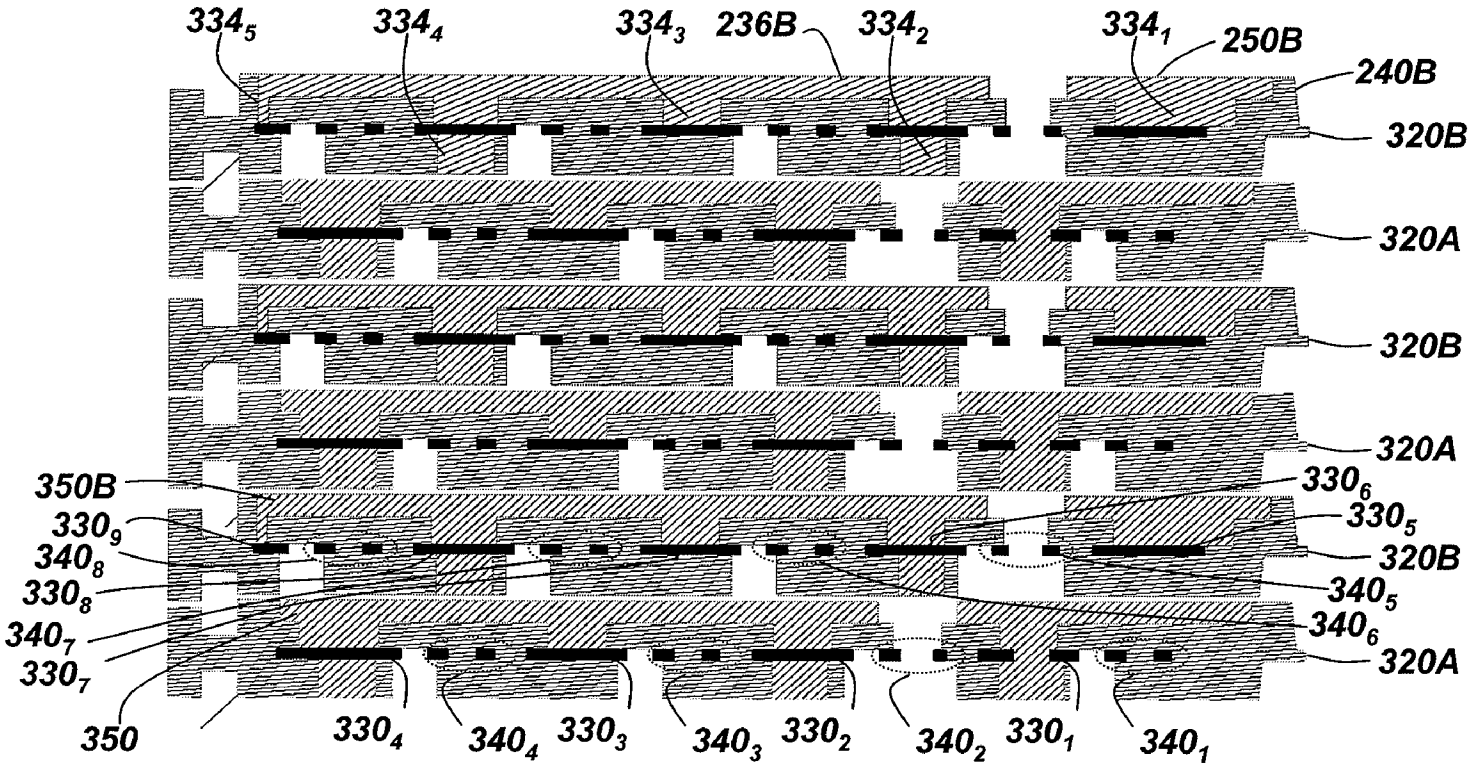
FIG. 3 is a cross-sectional representation of a plurality of wafers stacked together according to an embodiment of the present invention.

Lossy material may also be positioned to reduce the crosstalk between adjacent pairs in different columns. FIG. 3 illustrates a cross-sectional view similar to FIG. 2C but with a plurality of subassemblies or wafers 320A, 320B aligned side to side to form multiple parallel columns.

As illustrated in FIG. 3, the plurality of signal conductors 340 may be arranged in differential pairs in a plurality of columns formed by positioning wafers side by side. It is not necessary that each wafer be the same and different types of wafers may be used.

It may be desirable for all types of wafers used to construct a daughter card connector to have an outer envelope of approximately the same dimensions so that all wafers fit within the same enclosure or can be attached to the same support member, such as stiffener 128 (FIG. 1). However, by providing different placement of the signal conductors, ground conductors and lossy portions in different wafers, the amount that the lossy material reduces crosstalk relative for the amount that it attenuates signals may be more readily configured. In one embodiment, two types of wafers are used, which are illustrated in FIG. 3 as subassemblies or wafers 320A and 320B.

Each of the wafers 320B may include structures similar to those in wafer 320A as illustrated in FIGS. 2A, 2B and 2C. As shown in FIG. 3, wafers 320B include multiple differential pairs, such as pairs $\mathbf{340}_5$, $\mathbf{340}_6$, $\mathbf{340}_7$ and $\mathbf{340}_8$. The signal pairs may be held within an insulative portion, such as 240B of a housing. Slots or other structures (not numbered) may be formed within the housing for skew equalization in the same way that slots $\mathbf{264}_1$ . . . $\mathbf{264}_6$ are formed in a wafer 220A.

The housing for a wafer 320B may also include lossy portions, such as lossy portions 250B. As with lossy portions 250 described in connection with wafer 320A in FIG. 2C, lossy portions 250B may be positioned to reduce crosstalk between adjacent differential pairs. The lossy portions 250B may be shaped to provide a desirable level of crosstalk suppression without causing an undesired amount of signal attenuation.

In the embodiment illustrated, lossy portion 250B may have a substantially parallel region 336B that is parallel to the columns of differential pairs 3405 . . . 3408. Each lossy portion 250B may further include a plurality of perpendicular regions 3341B . . . 3345B, which extend from the parallel region 336B. The perpendicular regions 3341B . . . 3345B may be spaced apart and disposed between adjacent differential pairs within a column.

Wafers 320B also include ground conductors, such as ground conductors $\mathbf{330}_5$ . . . $\mathbf{330}_9$. As with wafers 320A, the ground conductors are positioned adjacent differential pairs $\mathbf{340}_5$ . . . $\mathbf{340}_8$. Also, as in wafers 320A, the ground conductors generally have a width greater than the width of the signal conductors. In the embodiment pictured in FIG. 3, ground conductors $330_5 \ldots 330_8$ have generally the same shape as ground conductors $330_1 \ldots 330_4$ in a wafer 320A. However, in the embodiment illustrated, ground conductor $330_9$ has a width that is less than the ground conductors $330_5 \ldots 330_8$ in wafer 320B.

Ground conductor $330_9$ is narrower to provide desired electrical properties without requiring the wafer 320B to be undesirably wide. Ground conductor $330_9$ has an edge facing differential pair $340_8$. Accordingly, differential pair $340_8$ is positioned relative to a ground conductor similarly to adjacent differential pairs, such as differential pair $330_8$ in wafer 320B or pair $340_4$ in a wafer 320A. As a result, the electrical properties of differential pair $340_8$ are similar to those of other differential pairs. By making ground conductor $330_9$ narrower than ground conductors $330_8$ or $330_4$, wafer 320B may be made with a smaller size.

A similar small ground conductor could be included in wafer 320A adjacent pair $340_1$. However, in the embodiment illustrated, pair $340_1$ is the shortest of all differential pairs within daughter card connector 120. Though including a narrow ground conductor in wafer 320A could make the ground configuration of differential pair $340_1$ more similar to the configuration of adjacent differential pairs in wafers 320A and 320B, the net effect of differences in ground configuration may be proportional to the length of the conductor over which those differences exist. Because differential pair $340_1$ is relatively short, in the embodiment of FIG. 3, a second ground conductor adjacent to differential pair $340_1$, though it would change the electrical characteristics of that pair, may have relatively little net effect. However, in other embodiments, a further ground conductor may be included in wafers 320A.

FIG. 3 illustrates a further feature possible when using multiple types of wafers to form a daughter card connector. Because the columns of contacts in wafers 320A and 320B have different configurations, when wafer 320A is placed side by side with wafer 320B, the differential pairs in wafer 320A are more closely aligned with ground conductors in wafer 320B than with adjacent pairs of signal conductors in wafer 320B. Conversely, the differential pairs of wafer 320B are more closely aligned with ground conductors than adjacent differential pairs in the wafer 320A.

For example, differential pair $340_6$ is proximate ground conductor $330_2$ in wafer 320A. Similarly, differential pair $340_3$ in wafer 320A is proximate ground conductor $330_7$ in wafer 320B. In this way, radiation from a differential pair in one column couples more strongly to a ground conductor in an adjacent column than to a signal conductor in that column. This configuration reduces crosstalk between differential pairs in adjacent columns.

Wafers with different configurations may be formed in any suitable way. FIG. 4A illustrates a step in the manufacture of wafers 320A and 320B according to one embodiment. In the illustrated embodiment, wafer strip assemblies, each containing conductive elements in a configuration desired for one column of a daughter card connector, are formed. A housing is then molded around the conductive elements in each wafer strip assembly in an insert molding operation to form a wafer.

To facilitate the manufacture of wafers, signal conductors, of which signal conductor 420 is numbered, and ground conductors, of which ground conductor 430 is numbered, may be held together on a lead frame 400 as shown in FIG. 4A. As shown, the signal conductors 420 and the ground conductors 430 are attached to one or more carrier strips 402. In one embodiment, the signal conductors and ground conductors are stamped for many wafers on a single sheet. The sheet may be metal or may be any other material that is conductive and provides suitable mechanical properties for making a conductive element in an electrical connector. Phosphor-bronze, beryllium copper and other copper alloys are example of materials that may be used.

FIG. 4A illustrates a portion of a sheet of metal in which wafer strip assemblies 410A, 410B have been stamped. Wafer strip assemblies 410A, 410B may be used to form wafers 320A and 320B, respectively. Conductive elements may be retained in a desired position on carrier strips 402. The conductive elements may then be more readily handled during manufacture of wafers. Once material is molded around the conductive elements, the carrier strips may be severed to separate the conductive elements. The wafers may then be assembled into daughter board connectors of any suitable size.

FIG. 4A also provides a more detailed view of features of the conductive elements of the daughter card wafers. The width of a ground conductor, such as ground conductor 430, relative to a signal conductor, such as signal conductor 420, is apparent. Also, openings in ground conductors, such as opening 332, are visible.

The wafer strip assemblies shown in FIG. 4A provide just one example of a component that may be used in the manufacture of wafers. For example, in the embodiment illustrated in FIG. 4A, the lead frame 400 includes tie bars 452, 454 and 456 that connect various portions of the signal conductors 420 and/or ground strips 430 to the lead frame 400. These tie bars may be severed during subsequent manufacturing processes to provide electronically separate conductive elements. A sheet of metal may be stamped such that one or more additional carrier strips are formed at other locations and/or bridging members between conductive elements may be employed for positioning and support of the conductive elements during manufacture. Accordingly, the details shown in FIG. 4A are illustrative and not a limitation on the invention.

Although the lead frame 400 is shown as including both ground conductors 430 and the signal conductors 420, the present invention is not limited in this respect. For example, the respective conductors may be formed in two separate lead frames. Indeed, no lead frame need be used and individual conductive elements may be employed during manufacture. It should be appreciated that molding over one or both lead frames or the individual conductive elements need not be performed at all, as the wafer may be assembled by inserting ground conductors and signal conductors into preformed housing portions, which may then be secured together with various features including snap fit features.

Figure 4B:
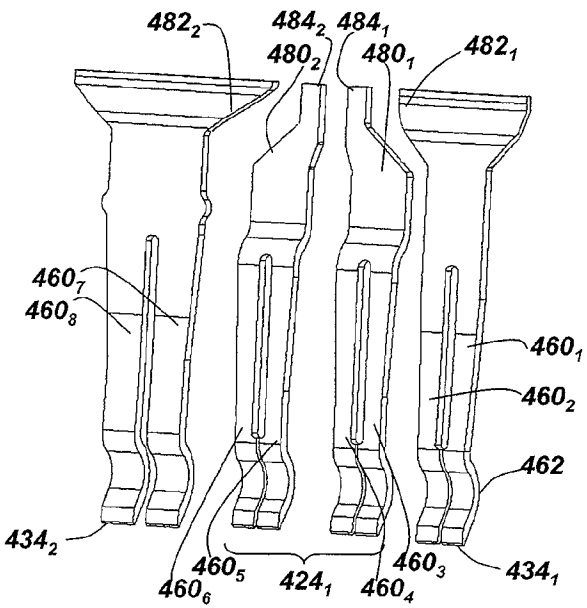
FIG. 4B is an enlarged detail view of the area encircled by arrow 4B-4B in FIG. 4A.
Figure 4A:
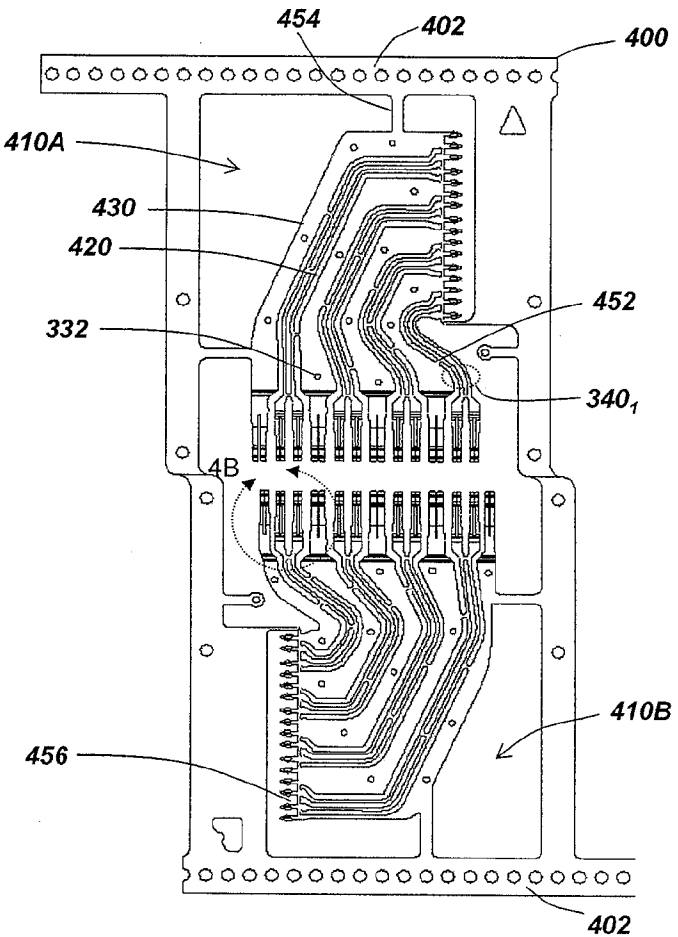
FIG. 4A is a plan view of a lead frame used in the manufacture of a connector according to an embodiment of the invention.

FIG. 4B illustrates a detailed view of the mating contact end of a differential pair $424_1$ positioned between two ground mating contacts $434_1$ and $434_2$. As illustrated, the ground conductors may include mating contacts of different sizes. The embodiment pictured has a large mating contact $434_2$ and a small mating contact $434_1$. To reduce the size of each wafer, small mating contacts $434_1$ may be positioned on one or both ends of the water.

FIG. 4B illustrates features of the mating contact portions of the conductive elements within the wafers forming daughter board connector 120. FIG. 4B illustrates a portion of the mating contacts of a wafer configured as wafer 320B. The portion shown illustrates a mating contact $434_1$ such as may be used at the end of a ground conductor $330_9$ (FIG. 3). Mating contacts $424_1$ may form the mating contact portions of signal conductors, such as those in differential pair $340_8$ (FIG. 3). Likewise, mating contact $434_2$ may form the mating contact portion of a ground conductor, such as ground conductor $330_8$ (FIG. 3).

In the embodiment illustrated in FIG. 4B, each of the mating contacts on a conductive element in a daughter card wafer is a dual beam contact. Mating contact $\mathbf{434}_1$ includes beams $\mathbf{460}_1$ and $\mathbf{460}_2$. Mating contacts $\mathbf{424}_1$ includes four beams, two for each of the signal conductors of the differential pair terminated by mating contact $\mathbf{424}_1$. In the illustration of FIG. 4B, beams $\mathbf{460}_3$ and $\mathbf{460}_4$ provide two beams for a contact for one signal conductor of the pair and beams $\mathbf{460}_5$ and $\mathbf{460}_6$ provide two beams for a contact for a second signal conductor of the pair. Likewise, mating contact $\mathbf{434}_2$ includes two beams $\mathbf{460}_7$ and $\mathbf{460}_8$.

Each of the beams includes a mating surface, of which mating surface 462 on beam $\mathbf{460}_1$ is numbered. To form a reliable electrical connection between a conductive element in the daughter card connector 120 and a corresponding conductive element in backplane connector 150, each of the beams $\mathbf{460}_1 \ldots \mathbf{460}_8$ may be shaped to press against a corresponding mating contact in the backplane connector 150 with sufficient mechanical force to create a reliable electrical connection. Having two beams per contact increases the likelihood that an electrical connection will be formed even if one beam is damaged, contaminated or otherwise precluded from making an effective connection.

Each of beams $\mathbf{460}_1 \ldots \mathbf{460}_8$ has a shape that generates mechanical force for making an electrical connection to a corresponding contact. In the embodiment of FIG. 4B, the signal conductors terminating at mating contact $\mathbf{424}_1$ may have relatively narrow intermediate portions $\mathbf{484}_1$ and $\mathbf{484}_2$ within the housing of wafer 320D. However, to form an effective electrical connection, the mating contact portions $\mathbf{424}_1$ for the signal conductors may be wider than the intermediate portions $\mathbf{484}_1$ and $\mathbf{484}_2$. Accordingly, FIG. 4B shows broadening portions $\mathbf{480}_1$ and $\mathbf{480}_2$ associated with each of the signal conductors.

In the illustrated embodiment, the ground conductors adjacent broadening portions $\mathbf{480}_1$ and $\mathbf{480}_2$ are shaped to conform to the adjacent edge of the signal conductors. Accordingly, mating contact $\mathbf{434}_1$ for a ground conductor has a complementary portion $\mathbf{482}_1$ with a shape that conforms to broadening portion $\mathbf{480}_1$. Likewise, mating contact $\mathbf{434}_2$ has a complementary portion $\mathbf{482}_2$ that conforms to broadening portion $\mathbf{480}_2$. By incorporating complementary portions in the ground conductors, the edge-to-edge spacing between the signal conductors and adjacent ground conductors remains relatively constant, even as the width of the signal conductors change at the mating contact region to provide desired mechanical properties to the beams. Maintaining a uniform spacing may further contribute to desirable electrical properties for an interconnection system according to an embodiment of the invention.

Some or all of the construction techniques employed within daughter card connector 120 for providing desirable characteristics may be employed in backplane connector 150. In the illustrated embodiment, backplane connector 150, like daughter card connector 120, includes features for providing desirable signal transmission properties. Signal conductors in backplane connector 150 are arranged in columns, each containing differential pairs interspersed with ground conductors. The ground conductors are wide relative to the signal conductors. Also, adjacent columns have different configurations. Some of the columns may have narrow ground conductors at the end to save space while providing a desired ground configuration around signal conductors at the ends of the columns. Additionally, ground conductors in one column may be positioned adjacent to differential pairs in an adjacent column as a way to reduce crosstalk from one column to the next. Further, lossy material may be selectively placed within the shroud of backplane connector 150 to reduce crosstalk, without providing an undesirable level attenuation for signals. Further, adjacent signals and grounds may have conforming portions so that in locations where the profile of either a signal conductor or a ground conductor changes, the signal-to-ground spacing may be maintained.

Figure 5B:
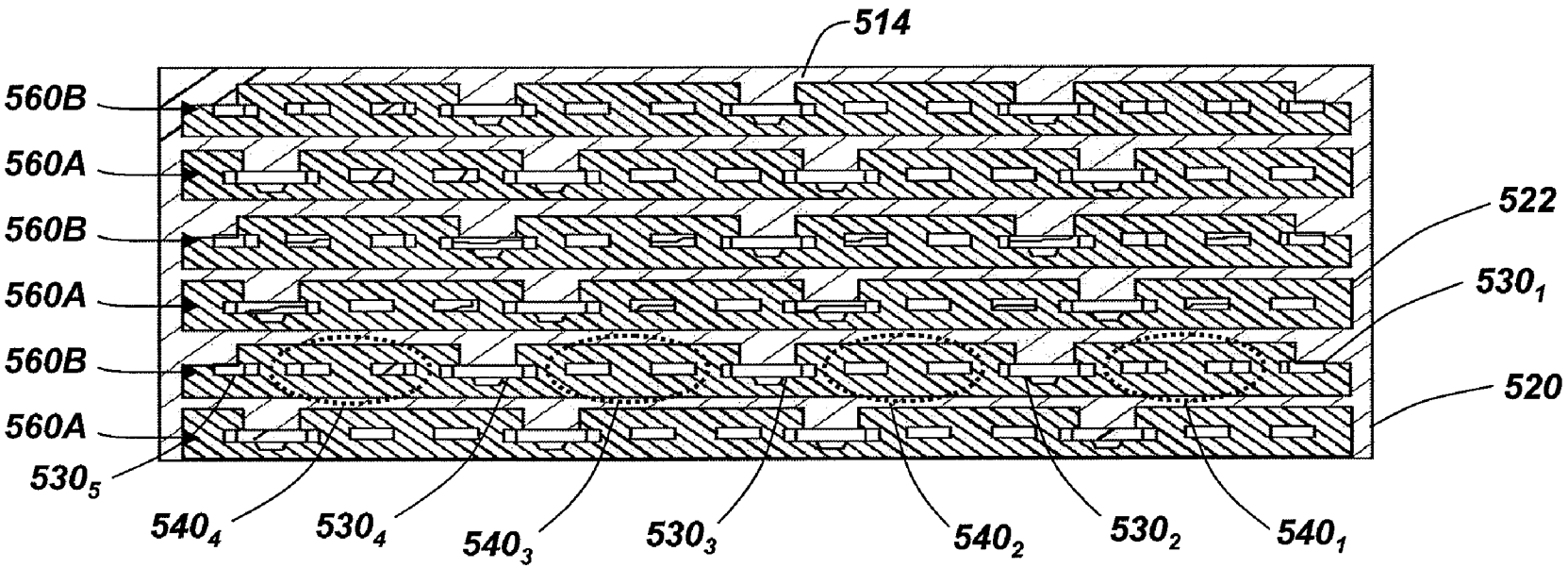
FIG. 5B is a cross-sectional representation of the backplane connector illustrated in FIG. 5A taken along the line 5B-5B.

FIGS. 5A-5B illustrate an embodiment of a backplane connector 150 in greater detail. In the illustrated embodiment, backplane connector 150 includes a shroud 510 with walls 512 and floor 514. Conductive elements are inserted into shroud 510. In the embodiment shown, each conductive element has a portion extending above floor 514. These portions form the mating contact portions of the conductive elements, collectively numbered 154. Each conductive element has a portion extending below floor 514. These portions form the contact tails and are collectively numbered 156.

The conductive elements of backplane connector 150 are positioned to align with the conductive elements in daughter card connector 120. Accordingly, FIG. 5A shows conductive elements in backplane connector 150 arranged in multiple parallel columns. In the embodiment illustrated, each of the parallel columns includes multiple differential pairs of signal conductors, of which differential pairs $\mathbf{540}_1, \mathbf{540}_2 \ldots \mathbf{540}_4$ are numbered. Each column also includes multiple ground conductors. In the embodiment illustrated in FIG. 5A, ground conductors $\mathbf{530}_1, \mathbf{530}_2 \ldots \mathbf{530}_5$ are numbered.

Ground conductors $\mathbf{530}_1 \ldots \mathbf{530}_5$ and differential pairs $\mathbf{540}_1 \ldots \mathbf{540}_4$ are positioned to form one column of conductive elements within backplane connector 150. That column has conductive elements positioned to align with a column of conductive elements as in a wafer 320B (FIG. 3). An adjacent column of conductive elements within backplane connector 150 may have conductive elements positioned to align with mating contact portions of a wafer 320A. The columns in backplane connector 150 may alternate configurations from column to column to match the alternating pattern of wafers 320A, 320B shown in FIG. 3.

Ground conductors $\mathbf{530}_2$, $\mathbf{530}_3$ and $\mathbf{530}_4$ are shown to be wide relative to the signal conductors that make up the differential pairs by $\mathbf{540}_1 \ldots \mathbf{540}_4$. Narrower ground conductive elements, which are narrower relative to ground conductors $\mathbf{530}_2$, $\mathbf{530}_3$ and $\mathbf{530}_4$, are included at each end of the column. In the embodiment illustrated in FIG. 5A, narrower ground conductors $\mathbf{530}_1$ and $\mathbf{530}_5$ are including at the ends of the column containing differential pairs $\mathbf{540}_1 \ldots \mathbf{540}_4$ and may, for example, mate with a ground conductor from daughter card 120 with a mating contact portion shaped as mating contact $\mathbf{434}_1$ (FIG. 4B).

FIG. 5B shows a view of backplane connector 150 taken along the line labeled B-B in FIG. 5A. In the illustration of FIG. 5B, an alternating pattern of columns of 560A-560B is visible. A column containing differential pairs $\mathbf{540}_1 \ldots \mathbf{540}_4$ is shown as column 560B.

FIG. 5B shows that shroud 510 may contain both insulative and lossy regions. In the illustrated embodiment, each of the conductive elements of a differential pair, such as differential pairs $\mathbf{540}_1 \ldots \mathbf{540}_4$, is held within an insulative region 522. Lossy regions 520 may be positioned between adjacent differential pairs within the same column and between adjacent differential pairs in adjacent columns. Lossy regions 520 may connect to the ground contacts such as $\mathbf{530}_1 \ldots \mathbf{530}_5$. Sidewalls 512 may be made of either insulative or lossy material.

FIGS. 6A, 6B and 6C illustrate in greater detail conductive elements that may be used in forming backplane connector 150. FIG. 6A shows multiple wide ground contacts $\mathbf{530}_2$, $\mathbf{530}_3$ and $\mathbf{530}_4$. In the configuration shown in FIG. 6A, the ground contacts are attached to a carrier strip 620. The ground contacts may be stamped from a long sheet of metal or other conductive material, including a carrier strip 620. The individual contacts may be severed from carrier strip 620 at any suitable time during the manufacturing operation.

As can be seen, each of the ground contacts has a mating contact portion shaped as a blade. For additional stiffness, one or more stiffening structures may be formed in each contact. In the embodiment of FIG. 6A, a rib, such as 610 is formed in each of the wide ground conductors.

Each of the wide ground conductors, such as $\mathbf{530}_2 \ldots \mathbf{530}_4$ includes two contact tails. For ground conductor $\mathbf{530}_2$ contact tails $\mathbf{656}_1$ and $\mathbf{656}_2$ are numbered. Providing two contact tails per wide ground conductor provides for a more even distribution of grounding structures throughout the entire interconnection system, including within backplane 160 because each of contact tails $\mathbf{656}_1$ and $\mathbf{656}_2$ will engage a ground via within backplane 160 that will be parallel and adjacent a via carrying a signal. FIG. 4A illustrates that two ground contact tails may also be used for each ground conductor in daughter card connector.

FIG. 6B shows a stamping containing narrower ground conductors, such as ground conductors $\mathbf{530}_1$ and $\mathbf{530}_5$. As with the wider ground conductors shown in FIG. 6A, the narrower ground conductors of FIG. 6B have a mating contact portion shaped like a blade.

As with the stamping of FIG. 6A, the stamping of FIG. 6B containing narrower grounds includes a carrier strip 630 to facilitate handling of the conductive elements. The individual ground conductors may be severed from carrier strip 630 at any suitable time, either before or after insertion into backplane connector shroud 510.

In the embodiment illustrated, each of the narrower ground conductors, such as $\mathbf{530}_1$ and $\mathbf{530}_2$, contains a single contact tail such as $\mathbf{656}_3$ on ground conductor $\mathbf{530}_1$ or contact tail $\mathbf{656}_4$ on ground conductor $\mathbf{530}_5$. Even though only one ground contact tail is included, the relationship between number of signal contacts is maintained because narrow ground conductors as shown in FIG. 6B are used at the ends of columns where they are adjacent a single signal conductor. As can be seen from the illustration in FIG. 6B, each of the contact tails for a narrower ground conductor is offset from the center line of the mating contact in the same way that contact tails $\mathbf{656}_1$ and $\mathbf{656}_2$ are displaced from the center line of wide contacts. This configuration may be used to preserve the spacing between a ground contact tail and an adjacent signal contact tail.

As can be seen in FIG. 5A, in the pictured embodiment of backplane connector 150, the narrower ground conductors, such as $\mathbf{530}_1$ and $\mathbf{530}_5$, are also shorter than the wider ground conductors such as $\mathbf{530}_2 \ldots \mathbf{530}_4$. The narrower ground conductors shown in FIG. 6B do not include a stiffening structure, such as ribs 610 (FIG. 6A). However, embodiments of narrower ground conductors may be formed with stiffening structures.

FIG. 6C shows signal conductors that may be used to form backplane connector 150. The signal conductors in FIG. 6C, like the ground conductors of FIGS. 6A and 6B, may be stamped from a sheet of metal. In the embodiment of FIG. 6C, the signal conductors are stamped in pairs, such as pairs $\mathbf{540}_1$ and $\mathbf{540}_2$. The stamping of FIG. 6C includes a carrier strip 640 to facilitate handling of the conductive elements. The pairs, such as $\mathbf{540}_1$ and $\mathbf{540}_2$, may be severed from carrier strip 640 at any suitable point during manufacture.

As can be seen from FIGS. 5A, 6A, 6B and 6C, the signal conductors and ground conductors for backplane connector 150 may be shaped to conform to each other to maintain a consistent spacing between the signal conductors and ground conductors. For example, ground conductors have projections, such as projection 660, that position the ground conductor relative to floor 514 of shroud 510. The signal conductors have complementary portions, such as complementary portion 662 (FIG. 6C) so that when a signal conductor is inserted into shroud 510 next to a ground conductor, the spacing between the edges of the signal conductor and the ground conductor stays relatively uniform, even in the vicinity of projections 660.

Likewise, signal conductors have projections, such as projections 664 (FIG. 6C). Projection 664 may act as a retention feature that holds the signal conductor within the floor 514 of backplane connector shroud 510 (FIG. 5A). Ground conductors may have complementary portions, such as complementary portion 666 (FIG. 6A). When a signal conductor is placed adjacent a ground conductor, complementary portion 666 maintains a relatively uniform spacing between the edges of the signal conductor and the ground conductor, even in the vicinity of projection 664.

FIGS. 6A, 6B and 6C illustrate examples of projections in the edges of signal and ground conductors and corresponding complementary portions formed in an adjacent signal or ground conductor. Other types of projections may be formed and other shapes of complementary portions may likewise be formed.

To facilitate use of signal and ground conductors with complementary portions, backplane connector 150 may be manufactured by inserting signal conductors and ground conductors into shroud 510 from opposite sides. As can be seen in FIG. 5A, projections such as 660 (FIG. 6A) of ground conductors press against the bottom surface of floor 514. Backplane connector 150 may be assembled by inserting the ground conductors into shroud 510 from the bottom until projections 660 engage the underside of floor 514. Because signal conductors in backplane connector 150 are generally complementary to the ground conductors, the signal conductors have narrow portions adjacent the lower surface of floor 514. The wider portions of the signal conductors are adjacent the top surface of floor 514. Because manufacture of a backplane connector may be simplified if the conductive elements are inserted into shroud 510 narrow end first, backplane connector 150 may be assembled by inserting signal conductors into shroud 510 from the upper surface of floor 514. The signal conductors may be inserted until projections, such as projection 664, engage the upper surface of the floor. Two-sided insertion of conductive elements into shroud 510 facilitates manufacture of connector portions with conforming signal and ground conductors.

Figure 7A:
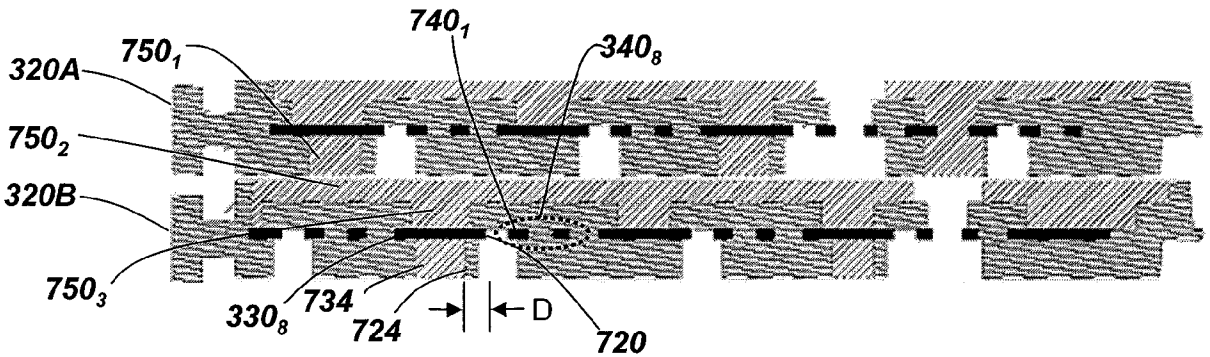
FIG. 7A is a cross-sectional representation of two wafers according to an embodiment of the present invention.
Figure 7B:
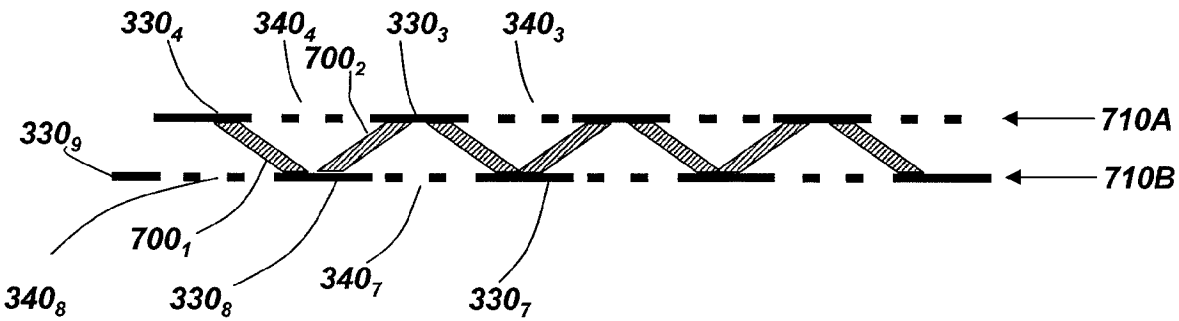
FIG. 7B is a schematic representation of two wafers according to an embodiment of the present invention.

FIGS. 7A and 7B illustrate additional detail of construction techniques that may be used to improve the electrical properties of a connector. As described above, lossy material may be selectively positioned near signal conductors to reduce crosstalk without causing an undesirably large attenuation of signals carried by the signal conductors. FIG. 7A illustrates that regions of lossy material may be set back from the edges of the ground conductors that are adjacent signal conductors as a way to reduce attenuation of signals. Taking ground conductor $\mathbf{330}_8$ as illustrative, ground conductor $\mathbf{330}_8$ has an edge 720 facing signal conductor $\mathbf{740}_1$ of pair $\mathbf{340}_8$. Lossy region 734 is set back from the edge 720 by a distance D.

In one embodiment, the width of the setback D is between approximately 0.1 mm and about 1 mm. In some embodiments, the setback may be as large as possible, though not so large as to make lossy region 734 so narrow that it cannot be effectively formed. However, it should be appreciated that in other embodiments, the setback D may be different and may depend on the width of ground conductors, such as ground conductor $330_8$. Accordingly, the present invention is not limited in this respect. By including such a setback, attenuation of the common mode component of the signal carried by differential pair $340_4$ is reduced in comparison to embodiments in which lossy region 734 extends to or beyond edge 720. Nonetheless, lossy region 734 is positioned to attenuate radiation emanating from pair $340_8$ that could cause crosstalk on adjacent signal conductors or radiation propagating toward pair $340_8$ that could cause crosstalk on differential pair $340_8$.

The space created by having a setback of the lossy region 734 from the edge 720 may be occupied with insulative material, such as an insulative segment 724 of the insulative portion 240 of the wafer housing. Alternatively, the setback portion may be occupied by air or any other suitable material that is less lossy than lossy region 734.

FIG. 7B provides an idealized representation of desirable locations for lossy material within a connector according to an embodiment of the invention. FIG. 7B illustrates two adjacent columns of conductive elements within a connector. In FIG. 7B, columns 710A and 710B are shown. As pictured in FIG. 7A, each column includes ground conductors, of which ground conductors $330_3$, $330_4$, $330_7$, $330_8$ and $330_9$ are numbered. Also, the columns include differential pairs, of which differential pairs $340_3$, $340_4$, $340_7$ and $340_8$ are numbered. FIG. 7B illustrates desirable placement locations for lossy regions, of which lossy regions $700_1$ and $700_2$ are numbered.

In the embodiment illustrated, the lossy regions occupy the volume between ground conductors in adjacent columns. The lossy regions are generally centered between adjacent differential pairs in the two columns. For example, lossy region $700_1$ occupies the volume between ground conductor $330_4$ in column 710A and ground conductor $330_8$ in column 710B. Lossy region $700_1$ is centered between differential pair $340_4$ in column 710A and $340_8$ in column 710B. Likewise, lossy region $700_2$ spans the volume between ground conductor $330_3$ and $330_8$ and is centered around the center line between differential pair $340_4$ and $340_7$.

With this placement of lossy material, crosstalk between adjacent differential pairs, whether in the same column or an adjacent column, may be reduced by the lossy material and shielding effects of the ground conductors. However, the regions proximate the signal conductors are free of lossy material, thereby limiting the amount of attenuation of signals carried by the differential pairs.

Figure 8:
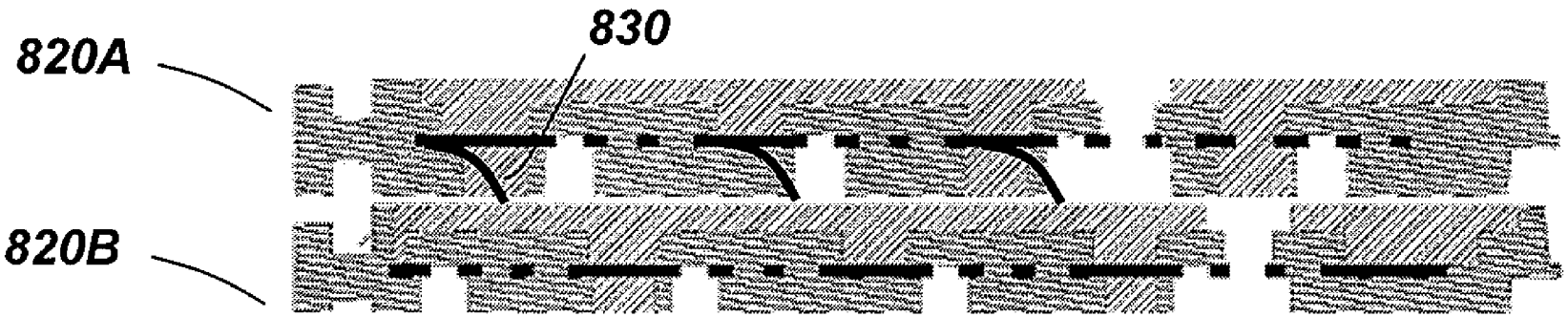
FIG. 8 is a cross-sectional representation of two wafers of an electrical connector according to alternative embodiments of the present invention.

In comparing the representation of FIG. 7B with the implementation according to the embodiment pictured in FIG. 7A, it can be seen that the lossy regions depicted in the embodiment of FIG. 7A generally occupy the locations indicated by lossy regions such as $700_1$ and $700_2$ in FIG. 7B. The configuration of FIG. 7A differs from the idealized representation of FIG. 7B so that the configuration of FIG. 7A is readily molded. To facilitate molding, the lossy regions extend generally perpendicular to the major surfaces of wafers 320A and 320B. Further, all lossy regions extend from one surface of each wafer, shown as the upper surface in FIG. 7B. Lossy regions comparable to the lossy regions depicted in FIG. 7B that are angled with respect to the normal surface of the wafers are formed with a combination of sub-regions of lossy material comprising sub-regions that extend along the upper surface of one of the wafers and extend perpendicular to the surfaces. For example, region 700, in the idealized representation may be molded using sub-regions 750, $750_2$ and $750_5$ (FIG. 7A). However, modifications to the construction of wafers, such as 320A and 320B, may be made to more nearly resemble the configuration illustrated in FIG. 7B. FIG. 8 illustrates an example of one such variation.

As shown in FIG. 8, structures are incorporated into the wafers, such as wafers 820A and 820B to expand the shielding effects in the volume between ground conductors in adjacent columns. Because each column is implemented in a separate wafer, there is no continuous structure that occupies the entire volume between ground conductors in adjacent columns. By incorporating structures that electrically connect the lossy region in one wafer to the lossy region in an adjacent wafer, the resulting structure may more nearly resemble the configuration of FIG. 7B in which continuous regions, such as region $700_1$ and $700_2$, span the volume between ground conductors in adjacent columns and are electrically connected to the ground conductors in adjacent columns. In the embodiment of FIG. 8, an electrical connection is formed between lossy regions in adjacent wafers by incorporating spring fingers, such as spring finger 830. Spring fingers may be formed as projections from ground conductors within one or both of the wafers or may be formed in any other suitable way.

Alternative embodiments in which the positioning of lossy material is configured to reduce crosstalk without producing an unacceptably large attenuation of signals are illustrated in connection with FIGS. 9A, 9B and 9C. In these embodiments, the lossy material is segmented into separate regions that are interspersed with regions of insulative material. The regions of lossy material may be positioned adjacent signal conductors to reduce crosstalk between adjacent signal conductors. By positioning lossy material in selected regions, the attenuation and signals carried by the signal conductors may be reduced. By appropriate selection of the configuration of the regions of lossy material, the lossy material may exhibit a suitable combination of effects on the performance of the connector.

Figure 9A:
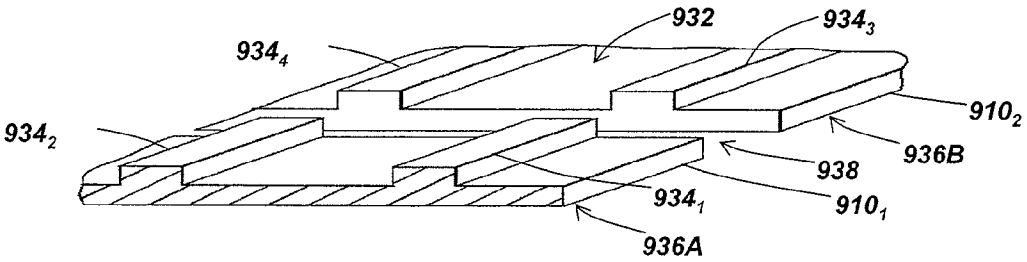
FIGS. 9A-9C are cross-sectional representations of lossy material portions of a wafer according to several embodiments of the present invention.
Figure 9B:
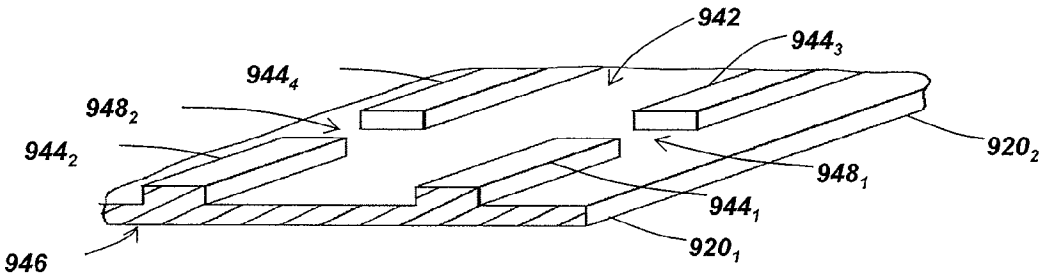
Figure 9C:
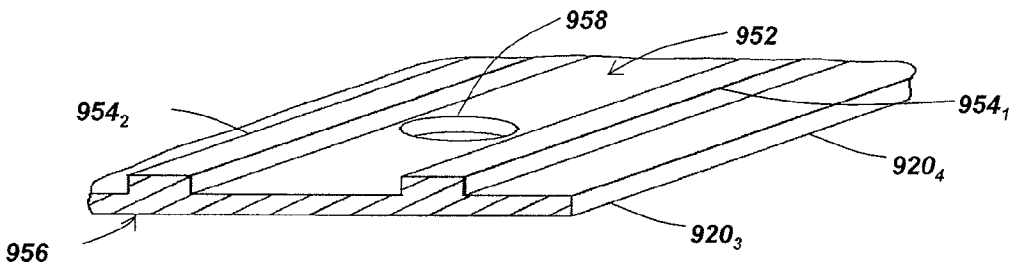

FIGS. 9A-9C illustrate cross-sectional representations of lossy material that may be incorporated in a wafer according to alternative embodiments of the present invention. Lossy material configured as illustrated may be incorporated into any of the above-described electrical connector components. Regions of lossy material may be separated by openings or voids in portions of the lossy material. The openings may be formed in any suitable way.

FIGS. 9A-9C illustrate various configurations of lossy material with such openings. The openings may be in one or both of the parallel region and the perpendicular region of the lossy material. An opening may be configured as a hole, gap, notch, or other volume free of lossy material of other suitable shape, as the invention is not limited in this respect. The openings in the lossy regions may contain air. However, as illustrated in FIGS. 2A and 2C, the lossy material 250 and insulative material 240 are molded together to define housing 260 of a wafer. Accordingly, openings in lossy material may be filled with insulative material 240. Such openings may be formed by first molding the lossy material in the desired segments and then over-molding with insulative material that fills the openings. Alternatively, the openings may be formed by molding the insulative material with portions occupying the volumes in which the openings are to be formed. When over-molding lossy material on such insulative material, the lossy material will be formed with openings in the desired locations.

FIG. 9A illustrates lossy material in a wafer, such as wafer 320A or 320B. The portion illustrated is in the vicinity of an intermediate portion of a differential pair along a fraction of its length. Portions with similar construction may be positioned along the entire length of the intermediate portion of the differential pair and along other differential pairs. In the embodiment of FIG. 9A, the opening is in the form of a gap 938 that separates the lossy material into segments $\mathbf{910}_1$ and $\mathbf{910}_2$.

Each segment $\mathbf{910}_1$ and $\mathbf{910}_2$ may include a parallel region 936A, 936B and one or more perpendicular regions, such as perpendicular regions $\mathbf{934}_1 \ldots \mathbf{934}_4$. A plurality of channels, of which channel 932 is illustrated, may be formed having a bottom defined by the parallel region 936A, 936B and sides defined by adjacent perpendicular regions $\mathbf{934}_1 \ldots \mathbf{934}_4$. Each channel 932 may be configured to receive a differential pair so that unwanted radiation emanating from the differential pair or radiating toward the differential pair is attenuated in the lossy material.

Each of the plurality of segments $\mathbf{910}_1$ or $\mathbf{910}_2$ may include at least a portion of at least one of the plurality of channels 932 separated by an opening or gap, such as gap 938, in the lossy material. As shown, perpendicular regions $\mathbf{934}_1 \ldots \mathbf{934}_2$ of a plurality of segments $\mathbf{910}_1$ and $\mathbf{910}_2$ may be aligned with each other such that channel 932 spans the plurality of segments, such as segments $\mathbf{910}_1$ and $\mathbf{910}_2$ of lossy material. When formed in a wafer such as 320A or 320B, channel 932 and gap 938 may be occupied by less lossy material used to form the housing of the wafer. However, any suitable technique may be used to form a gap and a channel.

FIG. 9A illustrates two segments. However, the number of segments formed may depend on one or more factors influencing the design of an overall connector. For example, more segments may be formed along the length of a longer differential pair than along the length of a shorter differential pair. The number of segments may also depend on the number of regions along the length of a differential pair where crosstalk suppression is desired or where avoidance of signal attenuation is desired. For example, segments of lossy material may be placed in a region where one differential pair is routed close to a second differential pair. Conversely, a gap in the lossy material, forming separate segments, may be desired proximate a signal conductor in regions where the signal conductor has a relatively wider spacing from an adjacent differential pair. Further, the number of gaps, and/or the length of those gaps, may be set in proportion to the length of the differential pair to provide approximately the same length of lossy material adjacent approximately each differential pair. Such a configuration, for example, may be more useful to provide a connector with approximately equal amounts of attenuation in each differential pair through the connector regardless of the length of the pair.

Regardless of the number, types and sizes of the lossy regions desired, the embodiment of FIG. 9A provides just one example of construction techniques that may be used to form multiple regions of lossy material adjacent a signal conductor. FIG. 9B illustrates an alternative construction technique. In the embodiment of FIG. 9B, openings in the lossy material that define separation between lossy regions are formed in the perpendicular regions.

Lossy regions $\mathbf{920}_1$ and $\mathbf{920}_2$ also include a channel 942 which may be configured to receive a signal conductor, such as a differential pair. In the embodiment illustrated in FIG. 9B, lossy regions $\mathbf{920}_1$ and $\mathbf{920}_2$ include a parallel region 946 and perpendicular regions $\mathbf{944}_1 \ldots \mathbf{944}_4$. In the embodiment of FIG. 9B, lossy regions $\mathbf{920}_1$ and $\mathbf{920}_2$ are separated by notches $\mathbf{948}_1$ and $\mathbf{948}_2$, which form an opening between perpendicular regions $\mathbf{944}_1$ and $\mathbf{944}_3$ as between $\mathbf{944}_2$ and $\mathbf{944}_4$, thereby separating region $\mathbf{920}_1$ from region $\mathbf{920}_2$.

FIG. 9C illustrates yet another embodiment of lossy material in which regions are formed. As with the embodiments of FIGS. 9A and 9B, FIG. 9C shows lossy material configured to form a channel 952. A signal conductor or differential pair may be positioned within channel 952. The lossy material in the embodiment of FIG. 9C is divided into regions $\mathbf{920}_3$ and $\mathbf{920}_4$. In the embodiment illustrated, regions $\mathbf{920}_3$ and $\mathbf{920}_4$ are separated by an opening or hole 958 that extends through the parallel region 956 of the lossy material. In this particular embodiment, hole 958 extends through the channel 952 of the lossy material. Though one generally round hole is shown, a hole of any desired size or shape may be used. The hole may be elongated to form a slot generally along the center of the channel 952. In other embodiments, a plurality of holes may be formed along the length of channel 952 in each segment.

Regions $\mathbf{920}_3$ and $\mathbf{920}_4$ represent two regions that may be formed along the length of one or more signal conductors disposed within channel 952. Any number of separate regions may be formed along the length of the signal conductors within channel 952. Forming openings along the centerline of a channel receiving signal conductors may be desirable because it contributes to positioning lossy material generally as pictured in FIG. 7B. For example, a hole in the floor of a channel of lossy material surrounding differential pair $\mathbf{340}_4$ would create a region relatively free of lossy material between pair $\mathbf{340}_4$ and ground conductor $\mathbf{330}_8$ (FIG. 7B). However, the remaining lossy material in parallel region 956 and perpendicular regions $\mathbf{954}_1$ and $\mathbf{954}_2$ would be generally in the position illustrated for lossy regions $\mathbf{700}_1$ and $\mathbf{700}_2$.

FIGS. 9A-9C demonstrate that lossy portion 250 may be shaped to control the amount of loss to signals relative to crosstalk suppression. As shown, the lossy portion 250 may include lossy members which form a plurality of channels 932, each for receiving a differential pair. In one embodiment, the signal conductors within a column may have different lengths and the lossy regions 250 may be sized and arranged to provide a higher loss per unit length to shorter conductors than to longer conductors.

Figure 10A:
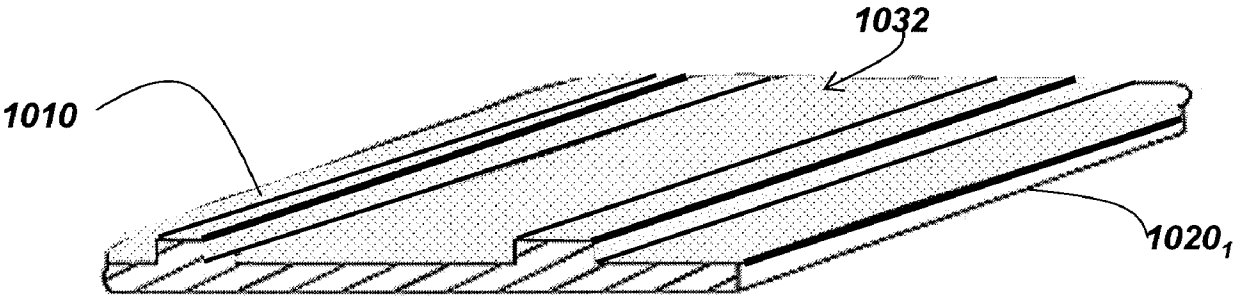
FIGS. 10A and 10B illustrate alternative embodiments of lossy regions.
Figure 10B:
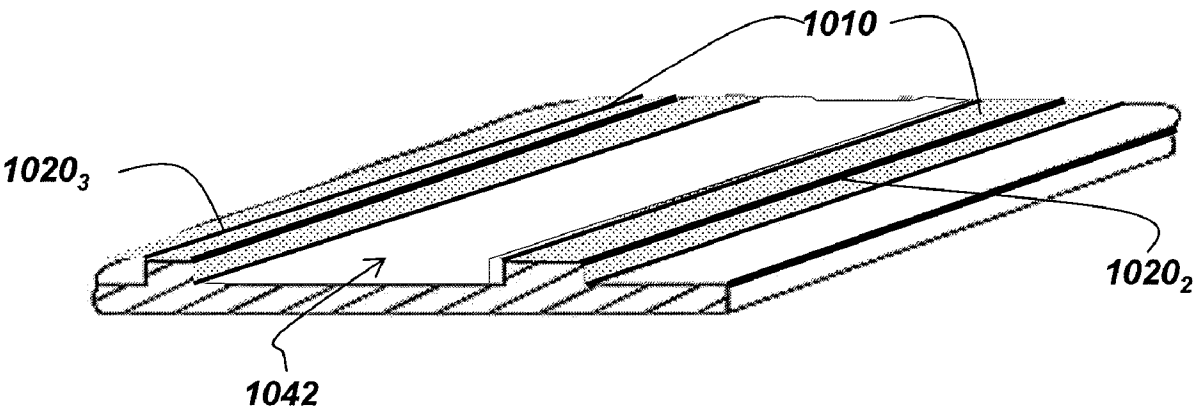

The lossy regions in the FIGS. 9A-9C are formed using a two shot molding operation. However, regions of lossy material may be formed in any suitable way. FIGS. 10A and 10B illustrate an alternative construction technique. In the embodiments of FIGS. 10A and 10B, the lossy regions may be formed by plating a partially conductive coating on a substrate, such as the insulative housing. A lossy material region may be formed by plating a lossy material. Alternative, a lossy region may be formed by plating a relatively highly conductive material in a relatively dispersed coating to provide a coating with a high resistivity. Though other manufacturing approaches are possible, including by bombarding a base material with molecules lines to change the loss properties of the base material.

FIG. 10A illustrates a portion of a conductive region forming a channel 1032 in which a differential pair may be positioned. A lossy region $\mathbf{1020}_1$ may be formed by applying a partially conductive coating 1010. Partially conductive coating 1010 may be applied in any suitable way. In the pictured embodiment, known techniques for plating plastics with metal or other conducting material may be used.

Once a partially conductive coating 1010 is applied, lossy region $\mathbf{1020}_1$ may be over molded with an insulative material. Though, in some embodiments, no further processing of a wafer may be required after a partially conductive coating is applied.

FIG. 10B illustrates an alternative embodiment. In the embodiment of FIG. 10B, masking or other suitable manufacturing technique is used to control the areas coated with partially conductive coating 1010. In the embodiment of FIG. 10B, structures to either side of channel 1042 are coated, but the floor of channel 1042 is not coated. As can be seen from FIG. 10B, using a partially conductive coating may provide greater control over the positioning of lossy regions.

Having thus described several aspects of at least one embodiment of this invention, it is to be appreciated various alterations, modifications, and improvements will readily occur to those skilled in the art.

As one example, a connector designed to carry differential signals was used to illustrate selective placement of lossy material to achieve a desired level of crosstalk reduction at an acceptable level of attenuation to signals. The same approach may be applied to connectors that carry single-ended signals. Also, shielding may be provided by capacitively coupling an electrically lossy member to two structures. Because no direct conducting path need be provided, it is possible that the electrically lossy material may be discontinuous, with electrically insulating material between segments of electrically lossy material.

Further, although many inventive aspects are shown and described with reference to a daughter board connector, it should be appreciated that the present invention is not limited in this regard, as the inventive concepts may be included in other types of electrical connectors, such as backplane connectors, cable connectors, stacking connectors, mezzanine connectors, or chip sockets.

As a further example, connectors with four differential signal pairs in a column were used to illustrate the inventive concepts. However, the connectors with any desired number of signal conductors may be used.

Also, FIG. 3 illustrates perpendicular portions of lossy material, such as portions $\mathbf{334}_1 \ldots \mathbf{334}_4$, contacting each ground conductor. However, it is not necessary that each perpendicular portion contact a ground conductor. Lossy regions could be coupled to conductors or other lossy regions other than by direct connection. For example, capacitive coupling could be employed and a suitable amount of coupling may be provided by establishing spacing between the lossy material and a ground conductor that achieves the desired amount of coupling. Further, it is not a requirement that every ground conductor be coupled to a perpendicular portion. In some embodiments, there may be no lossy region adjacent one or more of the ground conductors in a column. Omitting or reducing the width of perpendicular portions coupled to some or all of the ground conductors may reduce the amount of signal attenuation that occurs. Accordingly, the placement and width of lossy regions may be adjusted to provide a suitable level of signal attenuation relative to a suitable reduction in crosstalk, resonances or other anomalies that interfere with signal propagation.

Such alterations, modifications, and improvements are intended to be part of this disclosure, and are intended to be within the spirit and scope of the invention. Accordingly, the foregoing description and drawings are by way of example only.

What is claimed is:

1. An electrical connector comprising:

a) a plurality of signal conductors, the plurality of signal conductors being disposed in an array; and b) a housing comprising:

i) at least one insulative member disposed to hold the plurality of signal conductors in the array; and ii) at least one lossy member disposed along a length of a signal conductor to provide a plurality of lossy regions between the signal conductor and an adjacent signal conductor with at least one insulative region between adjacent lossy regions, wherein the at least one lossy member is electrically isolated from the signal conductor by the insulative member.

2. The electrical connector of claim 1, wherein the lossy regions and the at least one insulative region are adapted and arranged to reduce crosstalk between the signal conductor and the adjacent signal conductor with limited loss of signals carried by the signal conductor and adjacent signal conductor.

3. The electrical connector of claim 1, wherein the at least one insulative member comprises molded plastic and the at least one lossy member comprises molded plastic having conductive fillers.

4. The electrical connector of claim 1, wherein the at least one insulative member comprises molded plastic and the at least one lossy member comprises a plating on a surface of molded plastic that has lossy characteristics over a frequency range of 1 GHz to 12 GHz.

5. The electrical connector of claim 1, wherein the plurality of signal conductors are adapted and arranged to form a plurality of differential pairs and the plurality of lossy regions are disposed between adjacent signal conductors that form members of separate differential signal pairs.

6. The electrical connector of claim 1, wherein:

the plurality of signal conductors are arranged in a column;

the at least one lossy member comprises a parallel region parallel to the column and a plurality of perpendicular regions, extending from the parallel region; and the at least one insulative region comprises at least one opening in the parallel region between adjacent perpendicular regions.

7. The electrical connector of claim 6, wherein:

the plurality of signal conductors in the column comprises a plurality of differential pairs, each pair having a first and a second signal conductor;

each of the plurality of perpendicular regions is disposed between an adjacent differential pair; and the at least one opening in the parallel region comprises at least one opening positioned between the first and second signal conductors of a pair.

8. The electrical connector of claim 7, wherein the at least one insulative region further comprises at least one opening in the perpendicular regions.

9. The electrical connector of claim 8, wherein:

the at least one opening in the parallel region comprises an opening in the parallel region between each adjacent perpendicular region; and the at least one opening in the perpendicular regions comprises an opening in each of the perpendicular regions, each opening in the perpendicular region in communication with an opening of the at least one opening in the parallel region, whereby each of the plurality of lossy regions comprises a U-shaped segment comprising a portion of the parallel region and a portion of the perpendicular regions and the plurality of lossy regions are separated by the openings in the perpendicular regions and the parallel regions.

10. The electrical connector of claim 1, wherein:

the plurality of signal conductors is arranged in a column;

the at least one lossy member comprises a parallel region parallel to the column and a plurality of perpendicular regions, extending from the parallel region; and the at least one insulative region comprises at least one opening in at least one region of the plurality of perpendicular regions.

11. The electrical connector of claim 1, wherein:

the plurality of signal conductors are disposed in a column comprising a plurality of differential pairs;

the at least one lossy member forms a plurality of channels having a bottom defined by a parallel region and sides defined by adjacent perpendicular regions extending from the parallel region, each of the channels receiving a differential pair; and each of the plurality of lossy regions comprises a portion of at least one of the plurality of channels separated by openings in the perpendicular regions.

12. The electrical connector of claim 1, wherein the at least one insulative region comprises air and/or a portion of the at least one insulative member.

13. The electrical connector of claim 1, wherein each of the at least one lossy members has a surface resistivity between 1 Ω/square and 100 Ω/square.

14. The electrical connector of claim 1, wherein each of the at least one lossy members has a surface resistivity between 1 sieman/meter and 30,000 siemans/meter.

15. The electrical connector of claim 1, wherein each of the at least one lossy members has a binder encapsulating conductive filler material.

16. An electrical connector comprising:

a) a plurality of signal conductors, the plurality of signal conductors being disposed in an array; and b) a housing comprising:

i) at least one insulative member disposed to hold the plurality of signal conductors in the array; and ii) at least one lossy member disposed along a length of a signal conductor to provide a plurality of lossy regions between the signal conductor and an adjacent signal conductor with at least one insulative region between adjacent lossy regions, wherein:

each signal conductor comprises a mating contact portion, a contact tail and an intermediate portion electrically coupling the mating contact portion to the contact tail, and the intermediate portion of each signal conductor is embedded in the at least one insulative member;

the plurality of signal conductors are arranged in a plurality of columns, the plurality of signal conductors in each of the plurality of columns comprising a plurality of differential pairs;

the at least one lossy member comprises a plurality of parallel regions and a plurality of perpendicular regions, each of the plurality of parallel regions being disposed parallel to a column of the plurality of columns and each of the plurality of perpendicular regions extending from a parallel region;

the at least one insulative region comprises at least one opening in each of the plurality of parallel regions between adjacent perpendicular regions;

the at least one lossy member comprises a lossy member adjacent each of the plurality of columns, each lossy member forming a plurality of channels having a bottom defined by the parallel region adjacent the column and sides defined by adjacent perpendicular regions, each of the channels receiving a differential pair and each of the plurality of lossy regions comprises a portion of at least one of the plurality of channels separated by the openings in the lossy member;

each of the plurality of perpendicular regions being disposed between an adjacent differential pair within a column of the plurality of columns; and the lossy regions and the insulative regions are adapted and arranged to reduce crosstalk between adjacent pairs of signal conductors with limited loss to signals carried by the pairs of the adjacent pairs of signal conductors.

17. The electrical connector of claim 16, further comprising a plurality of ground conductors, each of the ground conductors electrically connected to a perpendicular region of the plurality of perpendicular regions.

18. The electrical connector of claim 16, wherein each of the differential pairs in a column has a different length and the lossy regions are sized and arranged to provide a higher loss per unit length to shorter differential pairs than to longer differential pairs.

19. An electrical connector comprising:

a) a plurality of signal conductors, the plurality of signal conductors being disposed in an array having at least one column;

b) a plurality of ground conductors, each of the ground conductors:

being disposed in a column of the at least one column;

has a width extending in the direction of the column;

being disposed adjacent at least one signal conductor of the plurality of signal conductors in the column; and having at least one edge facing an edge of the at least one adjacent signal conductor; and c) a housing comprising a plurality of electrically lossy regions, each lossy region disposed adjacent to and extending perpendicularly relative to a respective ground conductors of the plurality of ground conductors;

wherein each perpendicularly extending lossy region of the plurality of lossy regions has a width less than the width of the respective ground conductor of the plurality of ground conductors such that the perpendicularly extending lossy region has a setback from the edge of the ground conductor in a direction away from the signal conductor adjacent the ground conductor.

20. The electrical connector of claim 19, further comprising at least one insulative portion, the insulative portion having a plurality of insulative regions; and wherein for each ground conductor, an insulative region of the plurality of insulative regions is positioned between an adjacent signal conductor and a perpendicularly extending lossy region and the insulative region is positioned in the setback.

21. The electrical connector of claim 20, wherein the insulative portion comprises molded plastic and is adapted and arranged to hold the plurality of signal conductors in an array.

22. The electrical connector of claim 20, wherein the insulative portion comprises a region of air.

23. An electrical connector comprising:

a) a plurality of signal conductors, the plurality of signal conductors being disposed in an array having at least one column;

b) a housing comprising a plurality of lossy regions, each lossy region adjacent at least one of the plurality of signal conductors; and c) a plurality of ground conductors, each of the ground conductors having an opening therethrough, and each of the ground conductors being disposed in a column of the at least one column, and each of the ground conductors being in electrical connection with a lossy region of the plurality of lossy regions;

wherein a portion of the lossy region in electrical connection with each ground conductor is disposed through the opening in the ground conductor.

24. The electrical connector of claim 23, wherein i) each of the ground conductors is disposed adjacent a signal conductor in the column;

ii) each of the ground conductors has an edge facing the adjacent signal conductor, iii) the lossy region in electrical connection with the ground conductor is disposed with a setback from the edge.

25. The electrical connector of claim 23, wherein:

i) the electrical connector comprises a plurality of subassemblies, each subassembly having a first side and a second side, and the subassemblies being aligned side-by-side;

ii) the at least one column comprises a plurality of columns, each column being positioned in a separate one of the plurality of subassemblies; and iii) in each subassembly a lossy region is exposed in a first side and at least one of the portions of the lossy region is electrically coupled to the second side.

26. The electrical connector of claim 25, wherein in each subassembly, at least one of the portions is exposed in the second side.

27. The electrical connector of claim 26, wherein the plurality of subassemblies are positioned to electrically couple the lossy regions of the plurality of subassemblies together, the coupling being formed by lossy regions exposed in the first sides of subassemblies of the plurality of subassemblies coupled to lossy regions exposed in the second sides of subassemblies of the plurality of subassemblies.

28. The electrical connector of claim 25, wherein in each subassembly a conductor exposed in the second side is electrically connected to at least one of the portions.

29. An electrical connector comprising:

a) a plurality of signal conductors, the plurality of signal conductors being disposed in an array having a plurality of columns;

b) a plurality of ground conductors, each of the ground conductors being disposed in a column of the plurality of columns; and c) a housing comprising a plurality of lossy regions, each lossy region comprising a binder with conductive fillers;

wherein each of the lossy regions is positioned between two adjacent columns:

i) in regions between two adjacent signal conductors, each of the two adjacent signal conductors being in a different one of the two adjacent columns; and ii) between two adjacent ground conductors, each of the two adjacent ground conductors being in a different one of the two adjacent columns.

30. The electrical connector of claim 29, wherein:

i) the plurality of signal conductors comprises a plurality of differential pairs with the ground conductors of the plurality of ground conductors disposed between adjacent differential pairs; and ii) lossy regions are disposed between two adjacent differential pairs, each adjacent differential pair being in a different one of the two adjacent columns.

31. The electrical connector of claim 29, wherein each lossy region is electrically connected to at least one of the two adjacent ground conductors.

32. The electrical connector of claim 29, wherein the housing comprises a plurality of subassemblies, each subassembly having an insulative portion holding a column of signal conductors.

* * * * *